US006374456B1

(12) United States Patent
Fort et al.

(10) Patent No.: US 6,374,456 B1
(45) Date of Patent: Apr. 23, 2002

(54) LINEAR MOTION TROLLEY AND TRACK SYSTEMS FOR OPERABLE WALLS

(75) Inventors: George E. Fort, Mokena, IL (US); Jerald A. McRoberts, New Castle, IN (US); N. Douglas Owens, Lynn, IN (US); Melvin W. Tompkins, New Castle, IN (US)

(73) Assignee: Modernfold, Inc., New Castle, IN (US)

( * ) Notice: Subject to any disclaimer, the term of this patent is extended or adjusted under 35 U.S.C. 154(b) by 0 days.

(21) Appl. No.: 09/608,179

(22) Filed: Jun. 30, 2000

Related U.S. Application Data

(60) Provisional application No. 60/141,975, filed on Jul. 1, 1999.

(51) Int. Cl.[7] ..... E05D 15/16

(52) U.S. Cl. ..... 16/96 R; 16/97; 16/95 R; 16/87.6 R

(58) Field of Search ..... 16/96 R, 97, 98, 16/95 R, 87.6 R, 87.8, 101, 102, 106, 107; 160/188, 199, 196.1, 201; 49/127, 404, 409

(56) References Cited

U.S. PATENT DOCUMENTS

| | | | | | |
|---|---|---|---|---|---|
| 3,552,474 | A | * | 1/1971 | Finnegan | 16/98 |
| 3,661,431 | A | * | 5/1972 | Wisecarver | 16/91 |
| 3,708,916 | A | * | 1/1973 | Karp, Jr. et al. | 16/97 |
| 3,829,929 | A | * | 8/1974 | Foltz et al. | 16/97 |
| 3,854,165 | A | * | 12/1974 | Haley | 16/96 R |
| 4,014,137 | A | * | 3/1977 | Willams | 49/130 |
| 4,159,556 | A | * | 7/1979 | Dickson | 16/87.4 R |
| 4,272,923 | A | * | 6/1981 | Anderson | 16/94 R |
| 4,401,033 | A | * | 8/1983 | Gerken | 49/409 |
| 4,837,891 | A | | 6/1989 | Toma et al. | |
| 4,991,257 | A | * | 2/1991 | Eutebach | 16/87 R |
| 5,042,555 | A | | 8/1991 | Owens | |
| 5,063,636 | A | | 11/1991 | Dickson | |
| 5,152,332 | A | | 10/1992 | Siener | |
| 5,181,296 | A | * | 1/1993 | Williams | 16/95 R |
| D335,624 | S | | 5/1993 | Siener | |
| 5,329,857 | A | | 7/1994 | Owens | |
| 5,339,881 | A | | 8/1994 | Owens | |
| 5,358,023 | A | | 10/1994 | Owens | |
| 5,467,559 | A | | 11/1995 | Owens | |
| 5,481,840 | A | | 1/1996 | Dickson | |
| 5,499,671 | A | | 3/1996 | Owens | |
| 5,522,445 | A | * | 6/1996 | Hoffman | 16/94 D |
| 5,603,192 | A | | 2/1997 | Dickson | |

OTHER PUBLICATIONS

Bishop–Wisecarver Corp., Pittsburg, CA, "Brochure: The Dua–L–Vee System: Three Components, Four Sizes.," (Jan. 17, 1993).

General Bearing Corp. of New York, "Brochure: Ball Bearings, Ball Transfers, Thrust Bearings.," (Jan. 17, 1980).

Bishop–Wisecarver Corp., Pittsburg, CA, "Brochure: The Natural Selection In Linear Motion: Product Overview., " (Jan. 17, 1996).

* cited by examiner

*Primary Examiner*—Chuck Y. Mah
(74) *Attorney, Agent, or Firm*—Baker & Daniels

(57) ABSTRACT

A track and trolley system for an operable wall panel which provides for linear motion. The track is mountable to a ceiling of a room and includes first and second surfaces. The trolley is attachable to the operable wall panel and includes first and second rotatable wheels that respectively engage the first and second track surfaces. The outer radial peripheries of the rotatable wheels and the engaged track surfaces are complementarily structured and arranged to limit movement of the first and second rotatable wheels relative to the surfaces of the track in the direction in which the axis of rotation of the track extends, while allowing the wheels to rotate about their axes of rotation and roll along the track surfaces.

26 Claims, 38 Drawing Sheets

LINEAR MOTION TROLLEY AND TRACK SYSTEMS FOR OPERABLE WALLS

CROSS-REFERENCE TO RELATED APPLICATION

This application claims the benefit under 35 U.S.C. § 119(e) of United States Provisional Application No. 60/141,975, filed Jul. 1, 1999.

FIELD OF THE INVENTION

The present invention pertains to operable walls movable to partition large rooms into smaller rooms, and, in particular, to a track and trolley system for an operable wall panel.

BACKGROUND OF THE INVENTION

Operable walls or partitions, also known as movable wall panel systems, find useful application in a variety of venues, such as classrooms, offices, convention facilities and hospitals. In these venues, the operable walls can be moved along tracks from which they are suspended to efficiently compartmentalize interior space into a multitude of separate, smaller rooms.

Known mechanisms by which operable panels are rollingly suspended from tracks come in a variety of designs. One known mechanism, which is a dual rotating or counter rotation carrier, includes a pair of tires that are stacked on a vertically extending axle and which engage staggered-height bars that project from opposite sides of the track. The disadvantages of this type of system are numerous. First of all, the existing tires do not engage the track bars along the outer radial periphery of the tires, but rather are arranged such that the downward facing, axial surfaces of the tires engage the track bars that jut below them. Another problem is that at intersections of the track, such mechanisms tend to get hung up or jam, and the user often has to manually lift up the panels to unjam the carrier within the track.

Another panel suspension system uses trolleys with wheels, rotatable about horizontal axes, which run along a track. One disadvantage of these trolley designs is that when the panels are arranged in a stacked or folded arrangement, forces applied by a person during the unfolding of the panels tends to force the trolleys sideways or laterally within the track as opposed to along the length of the track. These lateral forces can cause wear to the trolleys, and further often do little to move the panel forward or backward. In some embodiments, additional rollers on flanges of the trolley which extend between the edges of tie track are provided to keep the trolley transversely centered within the track. However, and in addition to the fact that these rollers tend to wear out over time, such trolleys still can be difficult to move out of a stacked arrangement.

Thus, it would be desirable to provide a track and trolley system which overcomes these and other shortcomings of the prior art.

SUMMARY OF THE INVENTION

The present invention provides an operable wall with a trolley system that achieves linear motion, thereby resulting in the panels of the operable wall being movable in a smooth and relatively easy fashion between stacked and extended arrangements. The linear motion is achieved by providing trolley wheels, rotatable on a vertical axis, with outer peripheries that correspond to side-facing contours of the track.

In one form thereof, the present invention provides a system for movably suspending an operable wall panel, including a track mountable to a ceiling, a trolley attachable to the operable wall panel, and means on the track and the trolley for rollingly engaging the trolley to the track to provide a linear motion system in which the trolley moves linearly along the track.

In another form thereof, the present invention provides a system for movably suspending an operable wall panel including a track mountable to a ceiling and including first and second surfaces, and a trolley attachable to the operable wall panel and including first and second rotatable wheels each having an outer radial periphery, wherein an axis of rotation of each of the rotatable wheels extends in an axial direction. The outer radial peripheries of the first and second rotatable wheels and the first and second surfaces of the track are in operative engagement and are complementarily structured and arranged to limit movement of the first and second rotatable wheels in the axial direction relative to the first and second surfaces of the track.

One advantage of the present invention is that the application of even substantially lateral forces on panels equipped with the linear motion track and trolley system tends to cause the panels to move longitudinally along the track length.

Another advantage of the present invention is that its design reduces the likelihood of a trolley becoming jammed at track intersections.

Another advantage of the present invention is that vertical motion of the panels is prevented.

Still another advantage of the present invention is that the precision wheels/bearings and track achieve a smooth moving panel system.

Another advantage of the present invention is that the track may be formed with a heavy-duty construction to reduce the number of hanger brackets required to thereby facilitate installation.

BRIEF DESCRIPTION OF THE DRAWINGS

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
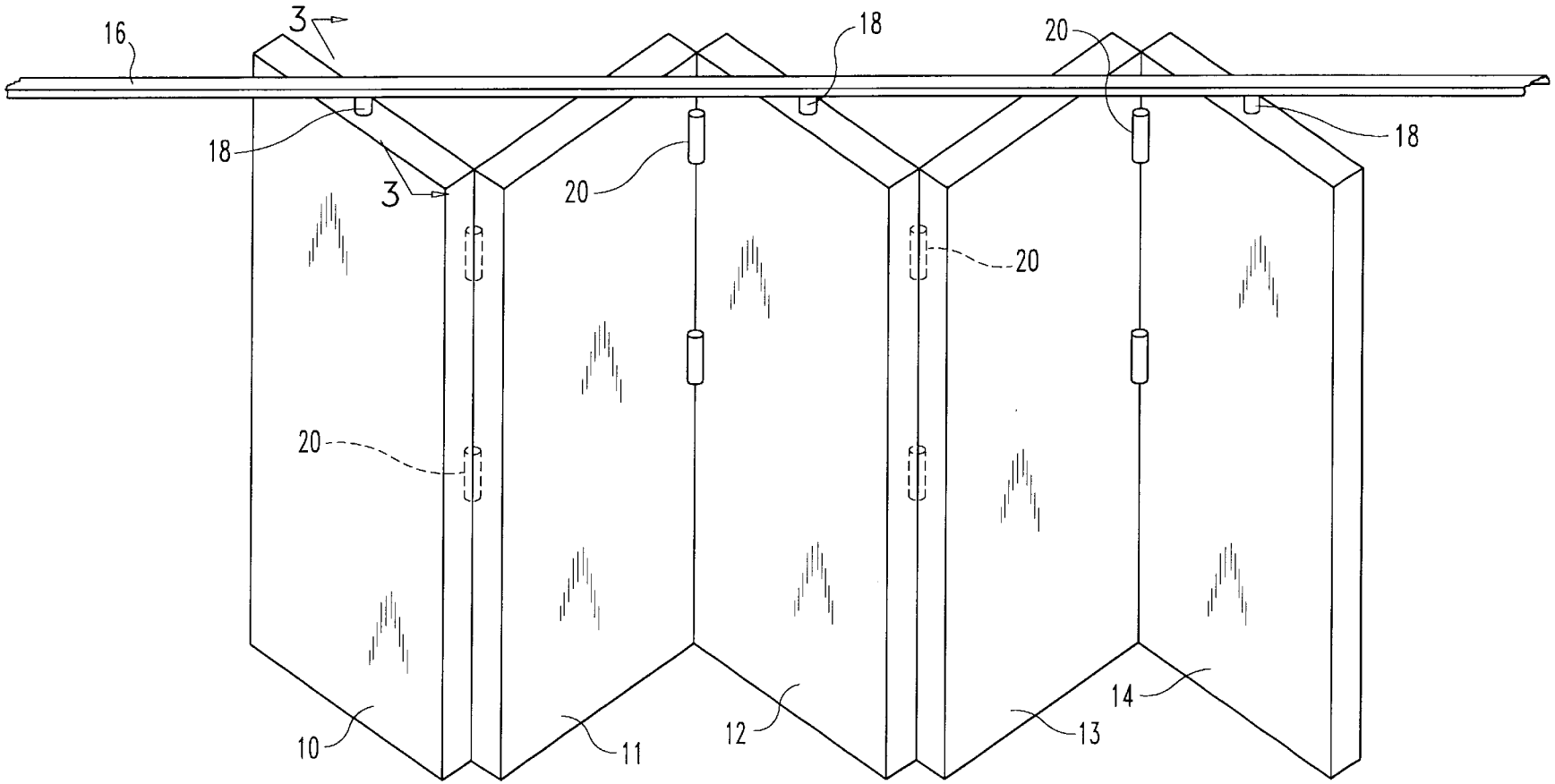
FIG. 1 is a diagrammatic perspective view of an operable wall panel system with which the various embodiments of the track and trolley system described herein may be employed.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the at may better utilize the teachings of the invention.

Referring now to FIG. 1, there is diagrammatically shown an operable wall panel system with which all of the linear motion trolley and track systems of the present invention may be advantageously employed. The panel system includes operable partitions or wall panels 10, 11, 12, 13 and 14 suspended from track 16 by trolleys 18. The term trolley is used generally herein and is intended to encompass wheeled devices, including carriages and carriers, of all types that are operably connected to and movable along the track. Each of wall panels 10–14 is linked to the adjacent panels by multiple hinges 20 arranged along the panel height. Track 16 is mountable in the ceiling of a room to be compartmentalized. Panels 10–14 may be moved along the track, either manually or by a drive system not shown, in wall stacking and wall extending directions. The wall panels may be of any conventional design. Furthermore, although shown as being employed with a continuously hinged panel system, the track and trolley systems described herein may be employed with different panel systems, including paired panel systems, or single panel systems, and with different or non-straight track layouts.

Figure 2:
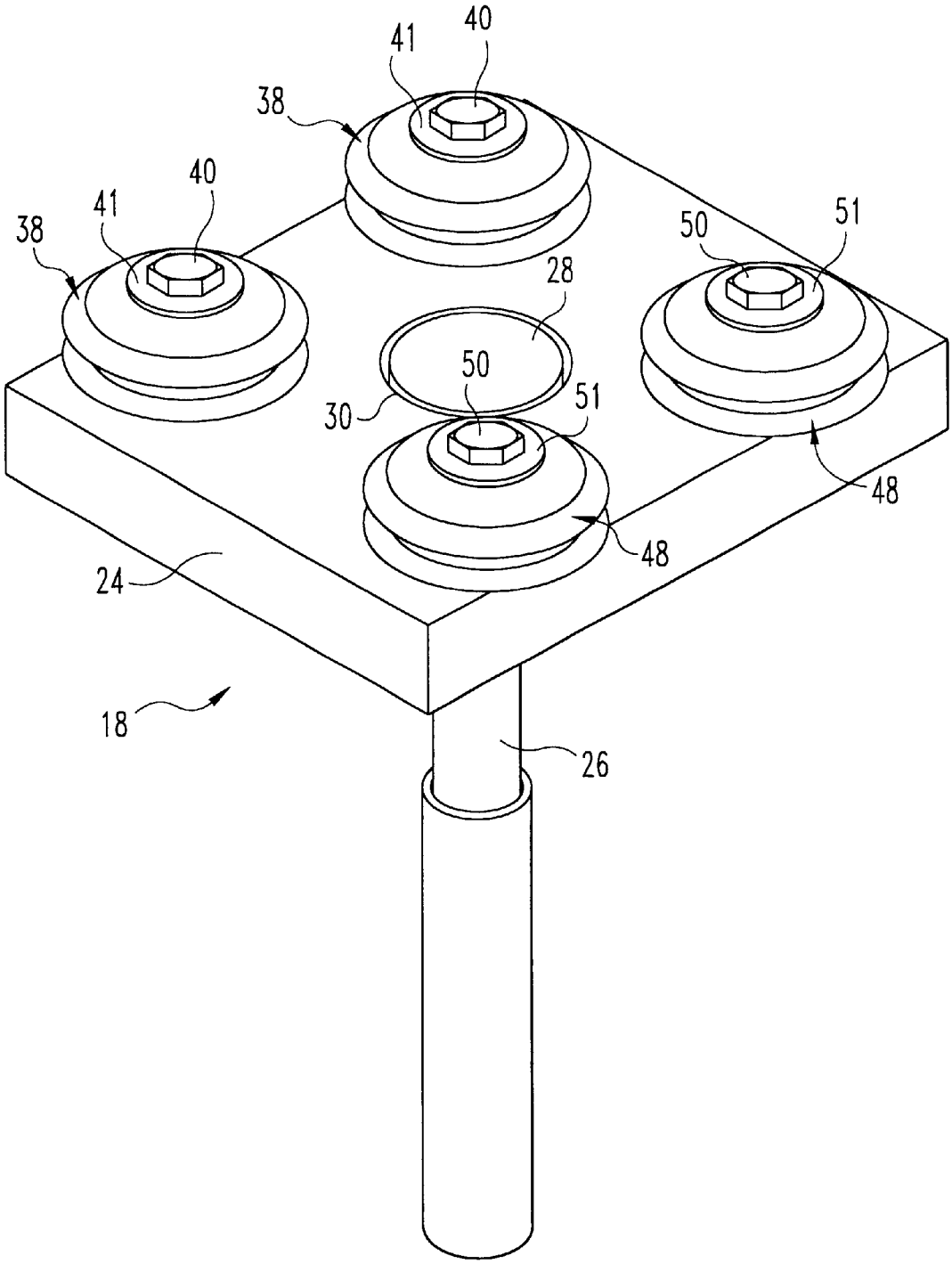
FIG. 2 is a diagrammatic perspective view of a linear motion trolley configured according to the present invention shown removed from the remainder of the operable wall panel system.
Figure 3:
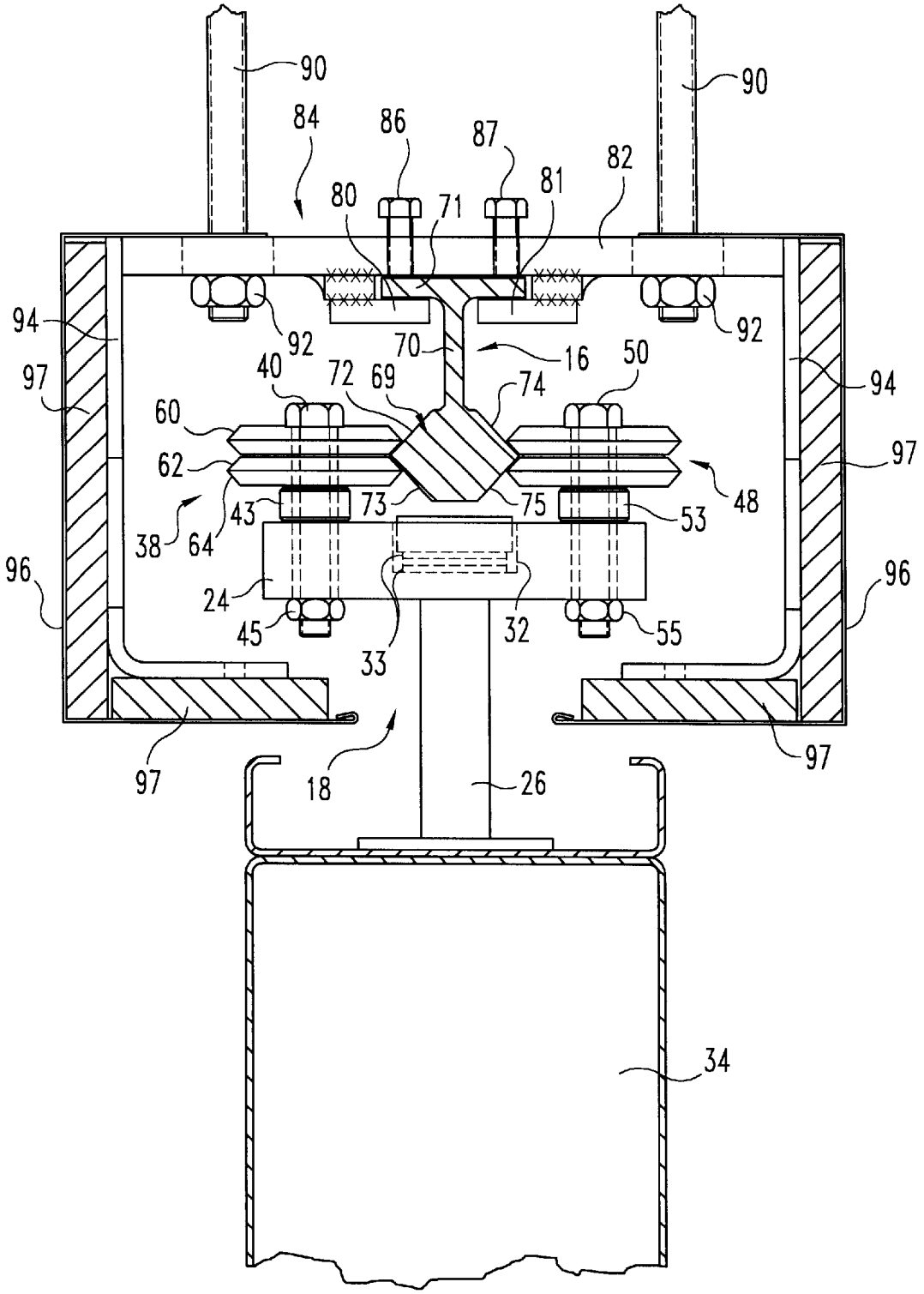
FIG. 3 is a cross-sectional view, conceptually taken along line 3—3 of FIG. 1, further illustrating a track and trolley system of the present invention in use.

With reference now to FIGS. 2 and 3, a configuration of a trolley particularly well suited for straight track runs is further described. Trolley 18 comprises a steel base plate 24 with a central bore through which extends a steel trolley bolt 26. The enlarged head 28 of trolley bolt 26 generally resides within a counterbore portion 30 of base plate 24 and suspends bolt 26 from plate 24. A thrust bearing 32 sandwiched between thrust races 33 is interposed between the underside of bolt head 28 and the bottom surface of counterbore 30 to permit relative rotation of trolley bolt 26 to base plate 24. The distal or lower end of trolley bolt 26 is attached to the upper end of an operable partition, which is generally designated as 34. The method of attachment of trolley bolt 26 to panel 34 is not shown or fully described herein as it may be of any type that is known in the art, as the particular form of the connection is not material to the present invention.

A pair of left-side track-engaging wheel assemblies, generally designated 38, are each attached to base plate 24 by means of a hex-head bolt 40 that passes through a washer 41 that is optional and only shown in FIG. 2. Bolt 40 continues in sequence through the interior race of wheel assembly 38, a steel spacer 43, and a smooth bore in base plate 24. Nut 45 is tightened on the bolt end to draw wheel assembly 38 into a secure attachment to base plate 24. A pair of right-side track-engaging wheel assemblies, generally designated 48, are each similarly attached to plate 24 with a hex-head bolt 50 flat passes through washer 51, the interior race of wheel assembly 48, a spacer 53, and a smooth bore through base plate 24, and which bolt is tightened by nut 55.

Two pairs of wheel assemblies, each of the left-side wheel assemblies 38 being directly across the track from a right-side wheel assembly 48, are utilized in the preferred embodiment. In alternate embodiments, additional wheel assemblies or fewer wheel assemblies may be provided on one or both sides of the track, but such configurations are not believed to improve and may detract from the performance of the trolley.

As shown in FIG. 3, the outer radial surface or periphery of wheel assembly 38 is not planar, but rather is adapted to conform to the track contour. Because each of wheel assemblies 38 and 48 comprise an identical construction, the following further description of the periphery of wheel assembly 38 has equal application to the other wheel assemblies. Wheel assembly 38 has a track-engaging outer radial periphery that is freely rotatable relative to bolt 40 due to bearings in the assembly located therebetween. This radial periphery of wheel 38 includes an upper beveled portion 60, an axially centered circumferential groove or channel portion 62, and a bottom beveled portion 64. For the track configuration shown in FIG. 3, channel portion 62 generally comprises a right triangular-shaped or V-shaped groove. As trolley 18 is intended to engage the track so as to prevent vertical panel motion in both an upward and a downward direction, the axially centered channel portion 62 is closely toleranced to the track to provide a close and conforming fit thereto. With corresponding changes in the lateral faces of the track, and provided any desired weight-sustaining capabilities or vertical motion preventing capabilities of the trolley are not compromised, other differently angled channel portions, or differently contoured outer radial peripheries such as one with a rounded concave or rounded convex shape, may be employed within the scope of the present invention. Wheel assemblies 38 and 48 are preferably precision ground steel and incorporate double row, angular contact ball bearings that have been prelubricated. Suitable wheel assemblies are available from Bishop-Wisecarver Corporation of Pittsburg, Calif., and are known as DUA-L-VEE® guide wheels.

Figure 4:
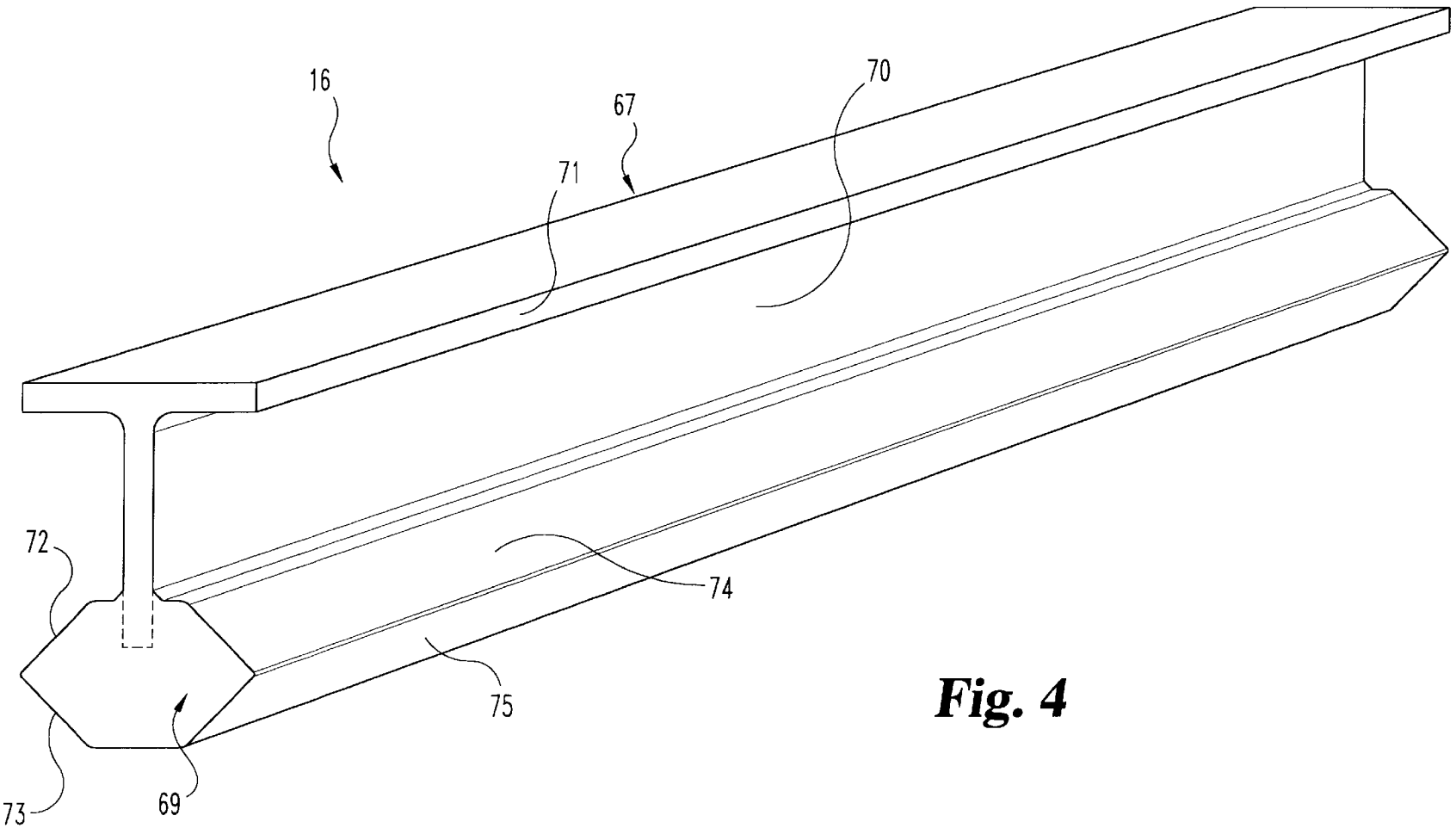
FIG. 4 is a perspective view of the track of FIG. 3 removed from the remainder of the operable wall panel system.

The cross-sectional configuration of track 16 shown in FIG. 3 generally corresponds to its configuration along its entire axial length. With additional reference to the perspective view of FIG. 4, track 16 is formed from assembling F together a standard steel T-beam 67 with a track-engaging head portion 69 made of hardened cold rolled steel. The bottom end of the downwardly extending flange 70 of T-beam 67 fits into a square groove milled into the upper region of head portion 69. Flange 70 and head portion 69 are welded together along their coextensive lengths to provide a satisfactory securement. In alternate embodiments, track 16 can be milled from a single piece of hardened cold-rolled steel, or other suitably strong and durable materials.

The laterally facing surfaces 72 and 73 of the left side of track head portion 69 which are engaged by both wheel assemblies 38 are oriented 90 degrees from each other to provide a squared comer that fits within the right triangular groove 62 in the wheel peripheries. The laterally facing surfaces 74 and 75 of the right side of track head portion 69 are similarly oriented 90 degrees from each other to provide a squared comer that fits within the right triangular grooves or channel portions on the outer radial periphery of wheel assemblies 48.

Track 16 is mounted to the ceiling support structure by means of hanger brackets, such as shown at 84, positioned at spaced intervals along the length of the track. Hanger bracket 84 includes a channel formed between flanges 80 and 81 welded to the underside of top bar 82 of the bracket. Locking screws 86 and 87 extend through tapped bores in the hanger bracket bar 82 and press the base flange 71 of T-beam 67 against the upper surface of flanges 80–81 in order to secure it to the hanger bracket. As is conventional, hanger rods 90 with securing nuts 92 are used to mount the hanger bracket 84 to the support structure. L-shaped sound bracket portions 94 of hanger bracket 84 are secured, such as by welding, to the opposite ends of hanger bracket bar 82. Soffit forming panel members 96 that extend the track length and are secured to hanger bracket 84 hold gypsum panels 97, or other sound-absorbing materials, against the sound bracket portions 94 to which panels 96 are attached with not shown fasteners.

Track 16 is sized and shaped complementary to trolley 18 such that except for small gaps due to machining tolerances, zero or only a very small gap is provided between the track-engaging surfaces of the wheel assemblies and the wheel assembly-engaging surfaces of the track. This close fit provides a more smoothly operating linear motion system.

Numerous other track configurations may be employed. For example, rather than engaging the inward facing portions of the left-side and right-side wheel assemblies 38 and 48, or in other words the regions of the wheel assemblies that constantly face each other, a track with track portions that engage the lateral or outward facing portions of the left-side and right-side wheel assemblies may be employed, possibly without modification to trolley 18. In addition, with modifications in the way the trolley bolt is attached to the panel, trolleys with wheels that revolve around horizontal axes and which engage upward and downward facing track surfaces may be employed.

Figure 5:
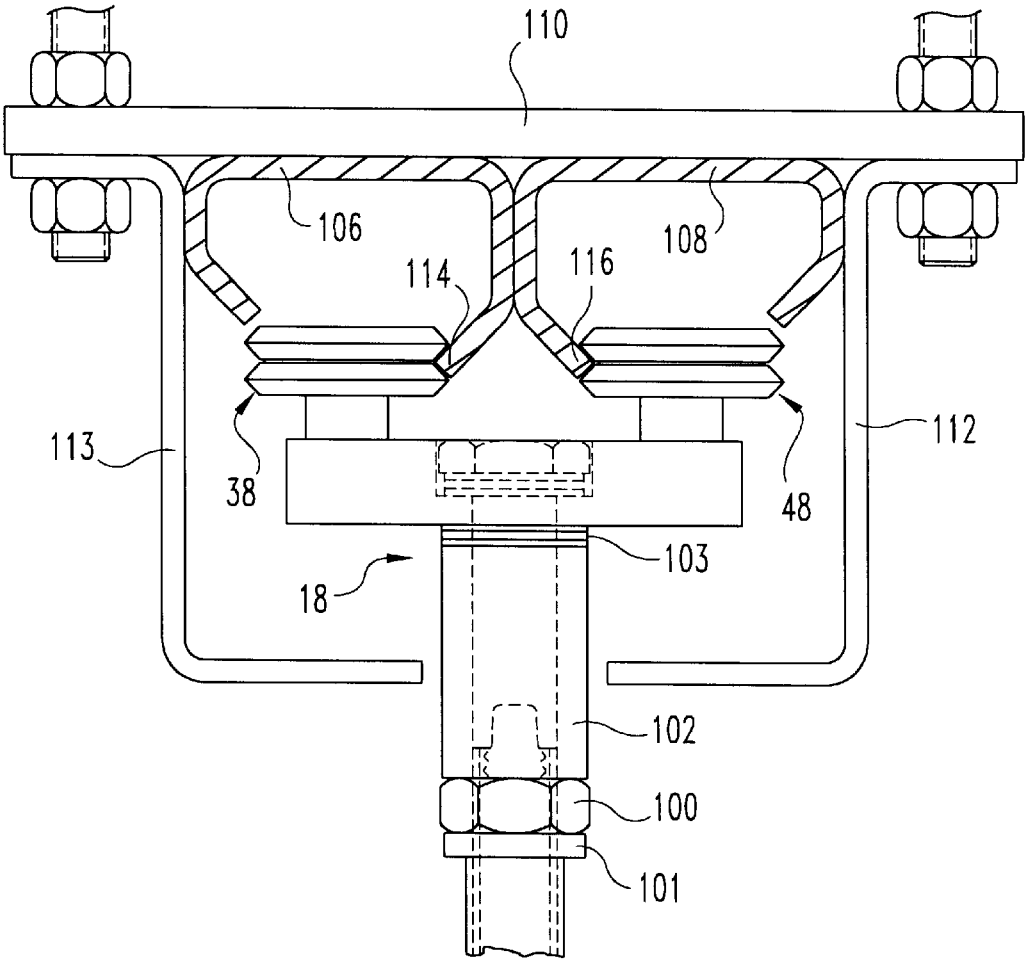
FIG. 5 cross-sectional view similar to FIG. 3 illustrating an alternate embodiment of aback and trolley system of the present invention.

Referring now to FIG. 5, there is shown a cross-sectional view of another track embodiment of the present invention. This track is shown in use with a trolley which is identical to trolley 18 of FIG. 3 (note that the bolts attaching the wheel assemblies are not shown), except that the trolley bolt is shown equipped with a nut 100, a lock washer 101, spacer 102 and a thrust bearing 103 to provide for attachment to a not shown operable panel. In this embodiment, the track is comprised of two mirror-image steel beams 106 and 108 that have the shown cross-section along their entire length. Beams 106 and 108 are welded or otherwise rigidly secured to hanger bracket bar 110 that can be mounted with hanger rods in a well-known fashion. The hanger bracket, a sufficient number of which are spaced along the track length, is also shown equipped with soffit brackets 112 and 113 to which not shown sound barrier elements and soffit panels may be attached. In this embodiment, the inward, squared-off ends 114 and 116 of beams 106 and 108, respectively, fit within and are directly engaged by the channel portions 62 of wheel assemblies 38 and 48. Steel beams 106 and 108 may be formed out of any conventional material that achieves a suitable strength, such as hardened cold-rolled steel.

Figure 6:
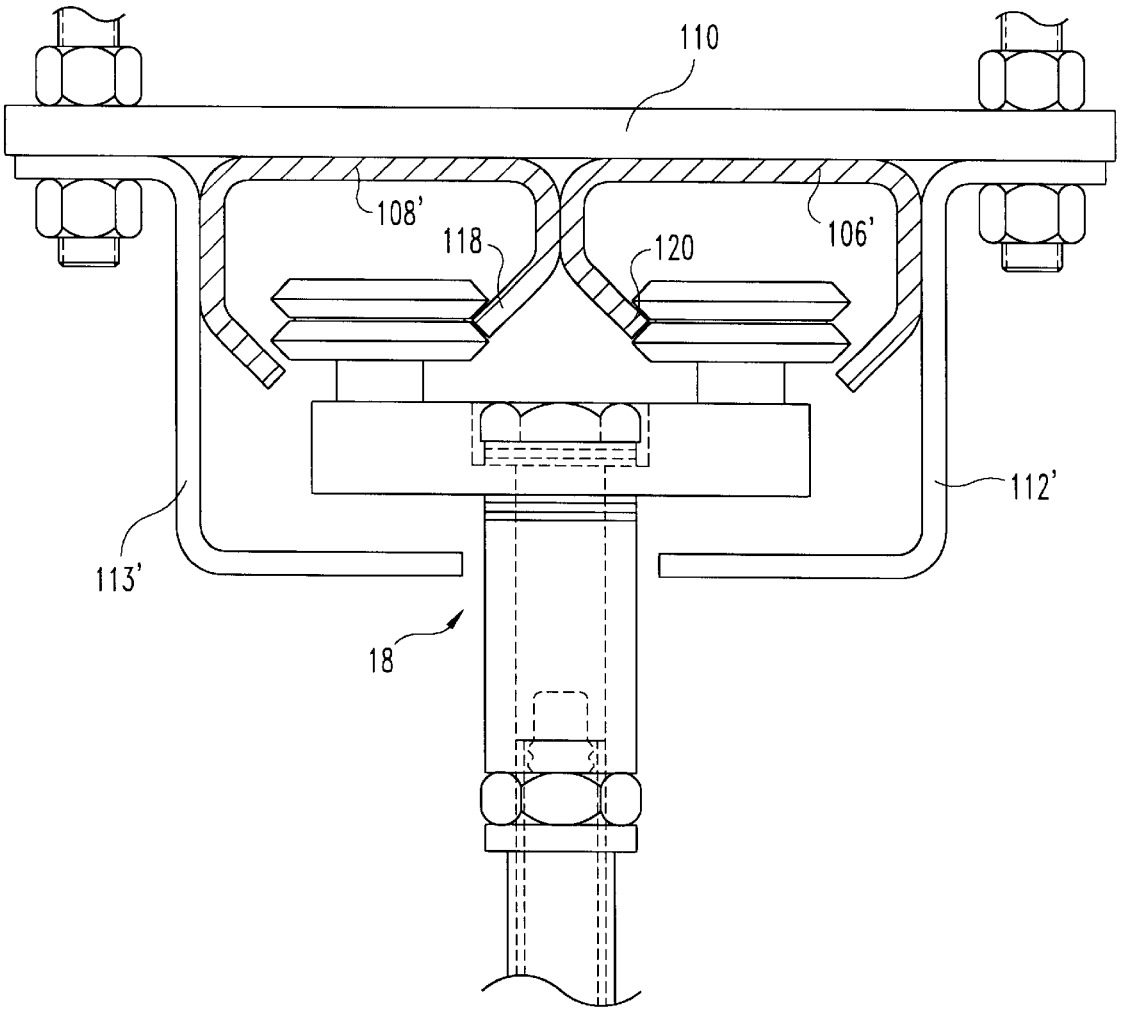
FIG. 6 is a cross-sectional view similar to FIG. 3 illustrating an alternate embodiment of track and trolley system of the present invention.

FIG. 6 is an alternate track configuration similar to that shown in FIG. 5, the difference being that the beam members 106' and 108' have been exchanged for beams 108 and 106, respectively, such that edges 118 and 120 are engaged by the wheel assemblies.

Figure 7:
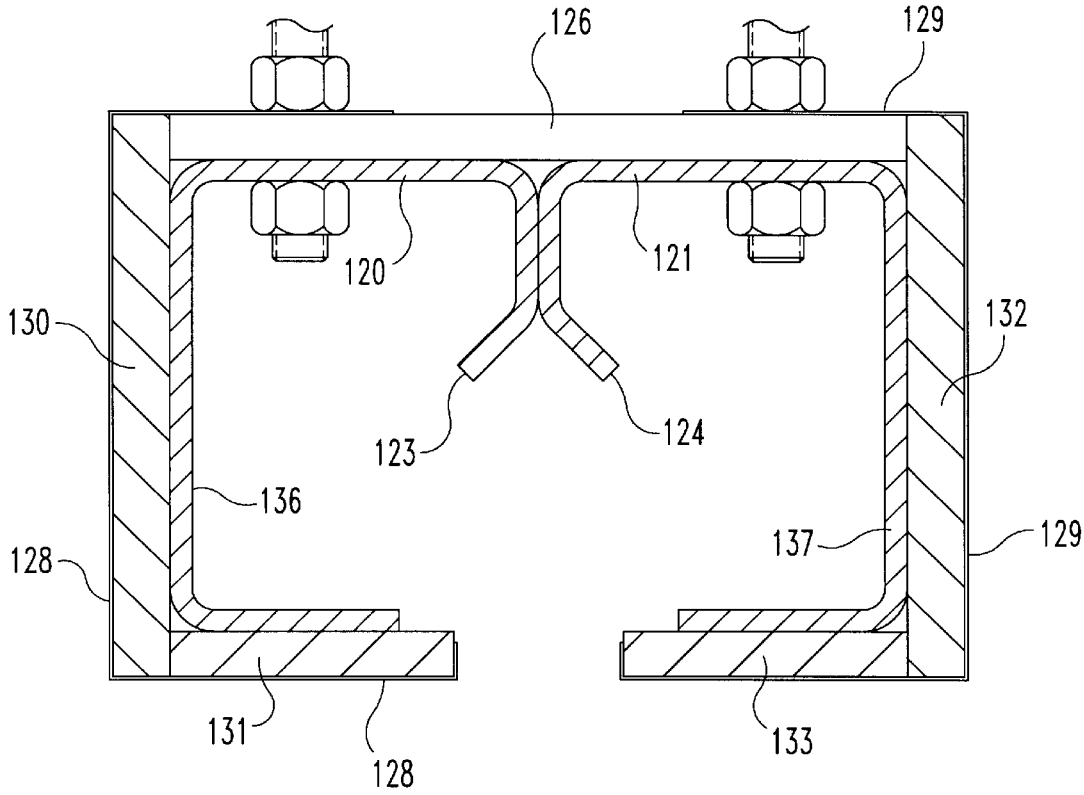
FIG. 7 is a cross-sectional view similar to FIG. 3 of an alternate embodiment of a track, wherein a trolley is not shown.

FIG. 7 is an alternate embodiment of a track of the present invention formed by mirror-image track sections 120 and 121 that are welded together. Track sections 120 and 121 include inward edges 123 and 124 that are engageable with the trolley 18 of FIG. 1 as described above. Hanger brackets 126, which are spaced at intervals along the axial length of the track sections 120 and 121 and are attached, such as by welding, to the track sections 120 and 121, are mounted to the support structure with the shown hanger rods. Soffit-forming panels 128 and 129 sandwich gypsum panels or other sound-absorbing members 130–133 against the downward and inwardly turned legs 136 and 137 of track sections 120 and 121, respectively.

Figure 8:
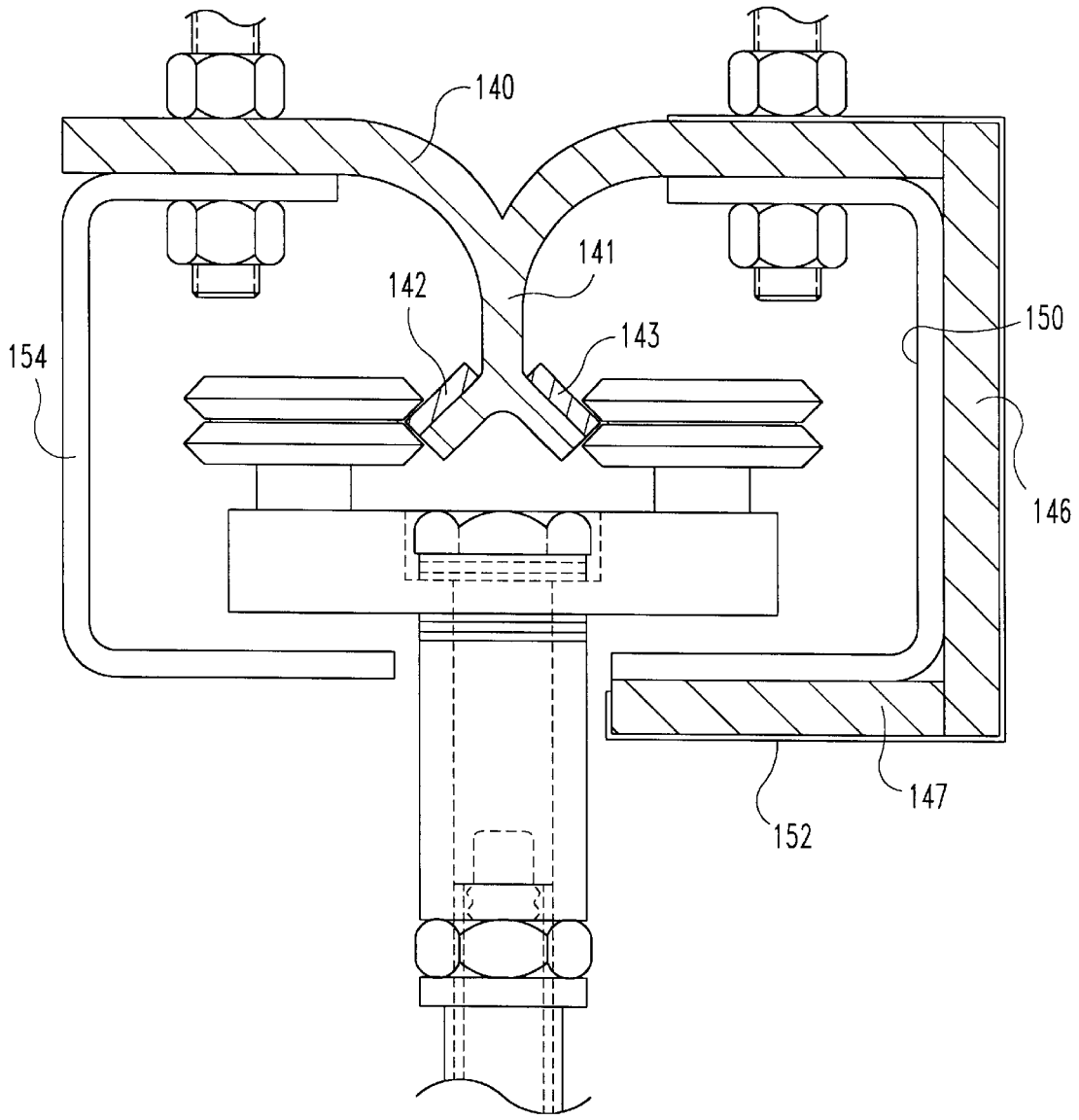
FIG. 8 is a cross-sectional view similar to FIG. 3 illustrating an alternate embodiment of a track and trolley system of the present invention.

FIG. 8 shows an alternate track configuration in which a multi-bowed track piece 140 includes a downwardly extending Y-portion 141. Track piece 140 is directly attachable to the support structure with the use of hanger rods. To increase the strength and useful life of the track, bars 142 and 143 are rigidly secured, such as by welding, to the upper surfaces of Y-portion 141 along the entire track length. This design allows for track piece 140 to be made of a lesser strength and/or lower cost material, such as extruded cold-rolled steel, while bars 142 and 143 are constructed from a stronger, more durable material such as hardened cold-rolled steel. As shown on the right-hand side of track piece 140, sound absorbing gypsum panels 146 and 147 can be sandwiched against a soffit bracket 150 via a soffit-forming panel 152. Soffit bracket 150, as well as bracket 154 attached to the left side of the shown track piece, are employed at spaced intervals along the actual length of the track. The mirror image gypsum panels and soffit-forming panel for the left side of the track are not shown in FIG. 8 but naturally are employed in most applications.

Figure 9:
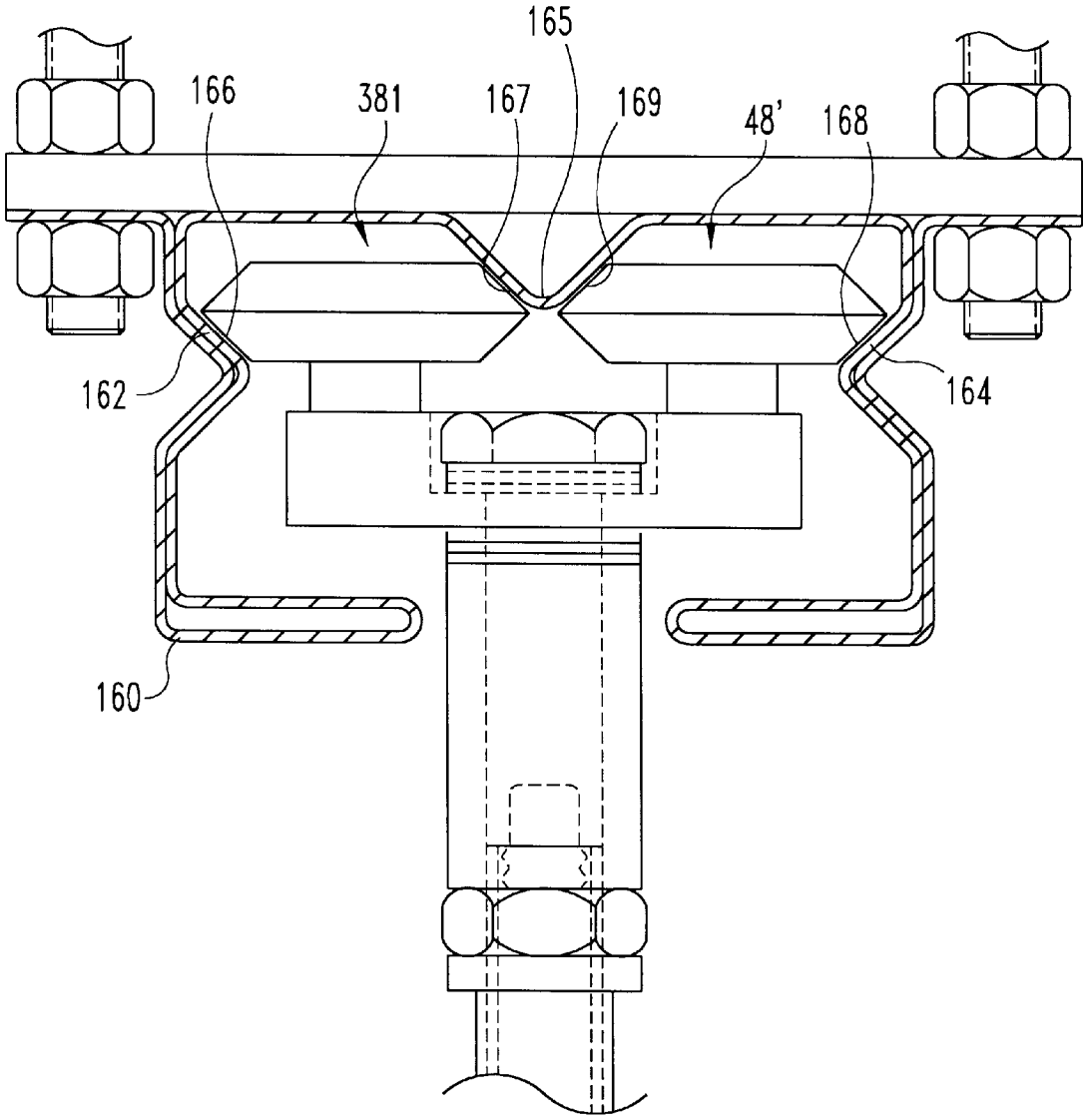
FIG. 9 is a cross-sectional view similar to FIG. 3 illustrating an alternate embodiment of a track and trolley system of the present invention.

FIG. 9 shows a cross-sectional view of still another embodiment of a track and trolley of the present invention. In this embodiment, the outer radial peripheries of wheel assemblies 38' and 48' each have a convex, right triangular shape. A single, multi-angled steel member 160 is configured to provide both a track and a soffit. Angled segments 162 and 164 serve as the tracks that engage the bottom beveled surfaces 166 and 168 of wheel assemblies 38' and 48', respectively. Downward track projection 165, which is right triangular in shape, prevents vertical upward movement, as well as side-to-side movement of the trolley relative to the track via possible engagement with top beveled surfaces 167 and 469 at inward regions of the wheel assemblies 38' and 48'.

Figure 10:
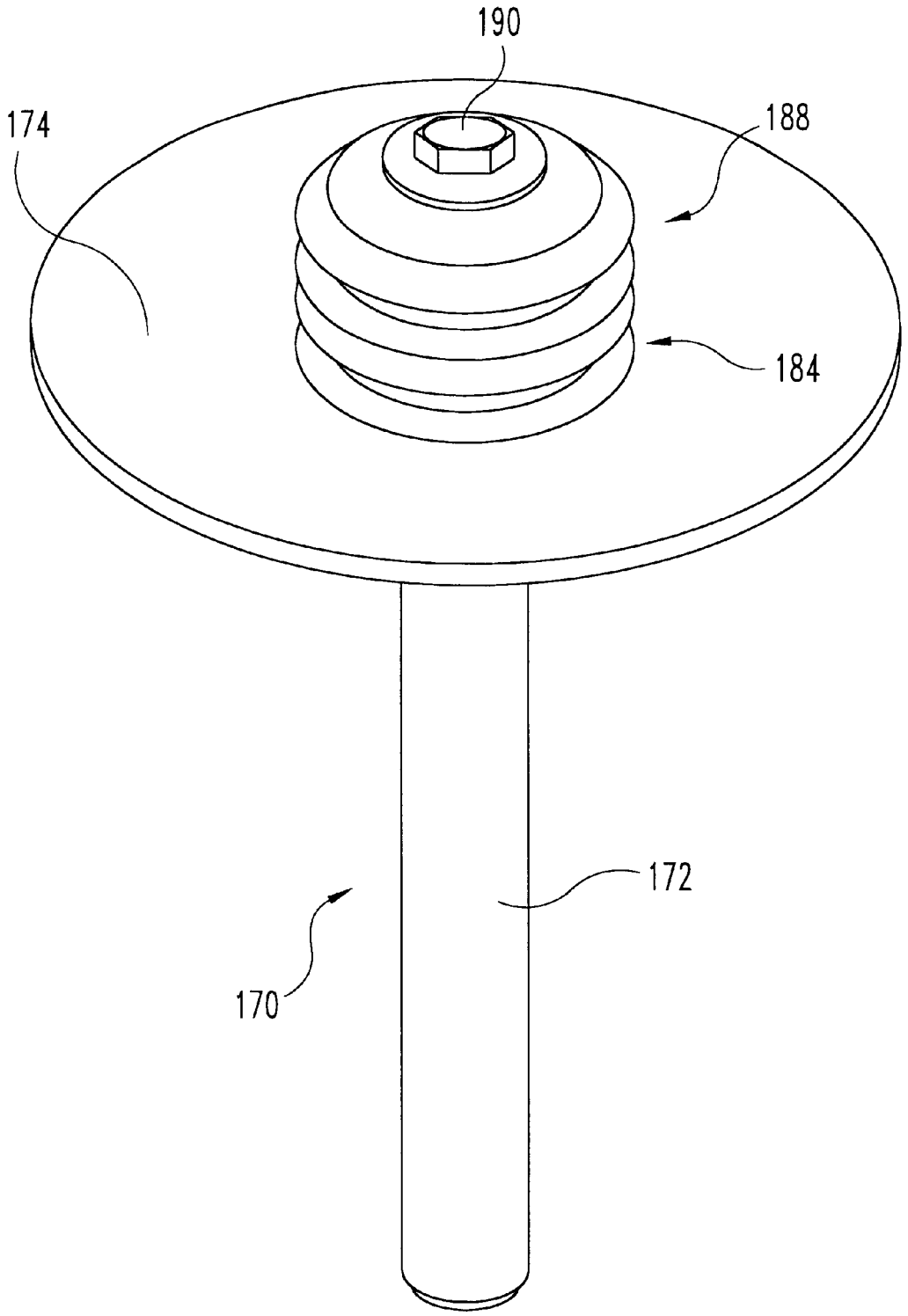
FIG. 10 is a diagrammatic perspective view of an alternate embodiment of a linear motion troll of the present invention.
Figure 11:
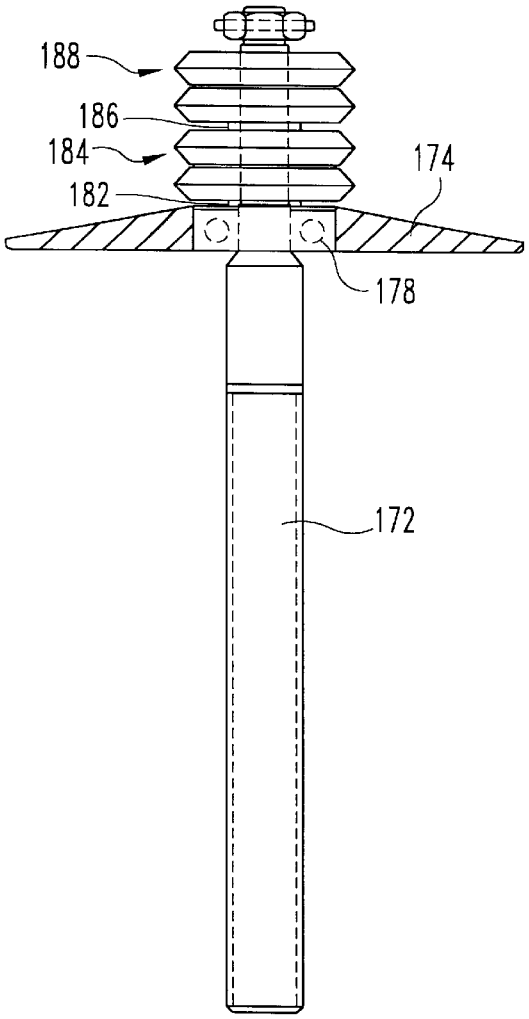
FIG. 11 is a front view, in partial cross-section, further illustrating the trolley of FIG. 10.
Figure 12:
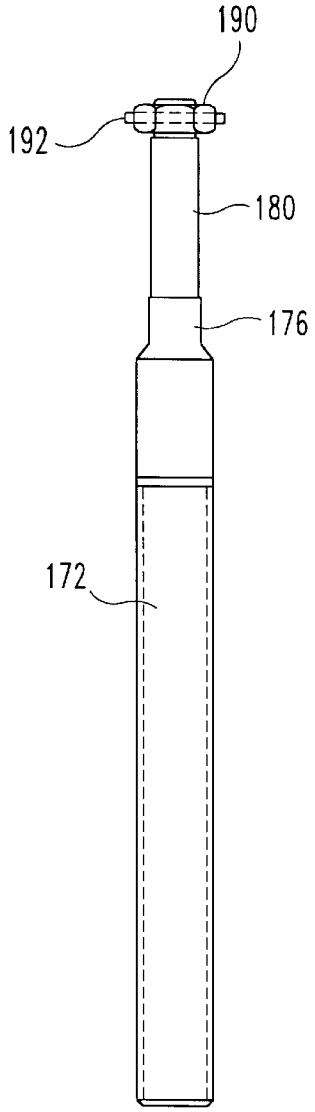
FIG. 12 is a front view of the trolley bolt of the trolley of FIG. 10.

Referring now to FIGS. 10–12, there is shown a linear motion trolley of the present invention which is particularly well suited for situations where the track on which it runs includes one or more "L-" or "Y-" or "X-" intersections. The trolley, generally designated 170, comprises a trolley bolt 172 that attaches at its bottom end in a conventional fashion to a not shown operable panel. A disc 174, which is preferably formed of a high-strength material such as steel and functions to suspend the operable panel at track intersections, is mounted on a stepped-down neck portion 176 of trolley bolt 172. In order to permit rotation of disc 174 relative to trolley bolt 172 to reduce disc wear, disc 174 is preferably mounted via a bearing indicated at 178 in FIG. 11.

Vertically stacked on disc 174 along a further stepped-down neck portion 180 of trolley bolt 172 are an annular-shaped steel spacer 182, a first wheel assembly, generally designated 184, a second annular-shaped steel spacer 186, and a second wheel assembly, generally designated 188. Disc 174 and the stacked wheel assemblies 184 and 188 are axially secured via a locknut 190 that screws onto the threaded upper end of trolley bolt 172. Pin 192 shown in FIGS. 12 and 13 preferably extends through nut 190 and a bore within trolley bolt 172 to prevent nut 190 from rotating once secured.

Wheel assemblies 184 and 188 are mounted and constructed so as to be free to rotate relative to one another, and in operation counter rotate (ie., rotate in opposite directions from one another). Wheel assemblies 184 and 188 are configured identically to the wheel assemblies 38 and 48 of the trolley embodiment of FIGS. 2–3, and therefore are not further described hereat. Wheel assemblies 184 and 188 also may be modified as described above with respect to wheel assemblies 38 and 48.

Figure 13:
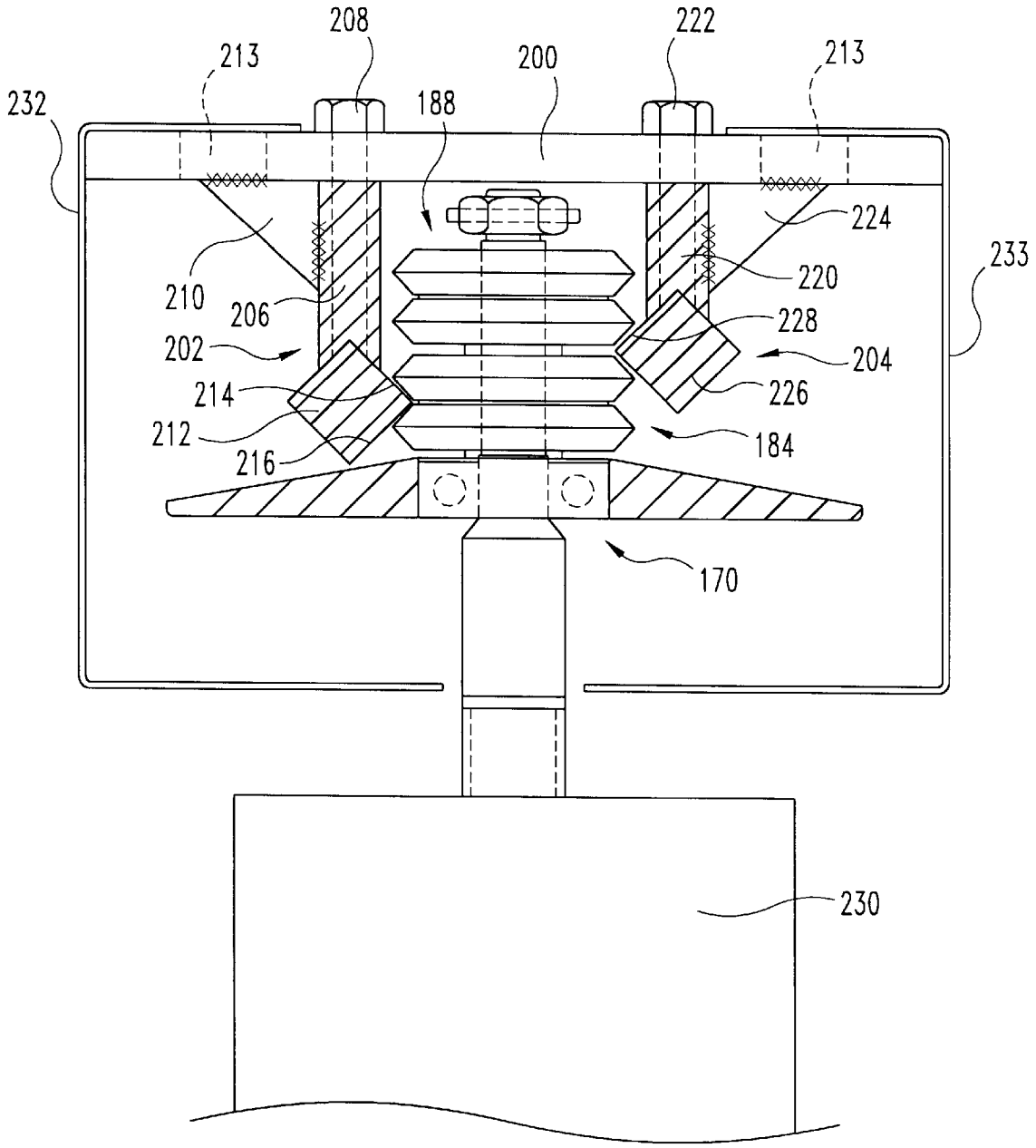
FIG. 13 is a front view of the trolley of FIG. 10 operatively installed in a track configured according to the present invention, wherein the track and trolley system is shown suspending an abstractly shown operable wall panel.
Figure 14:
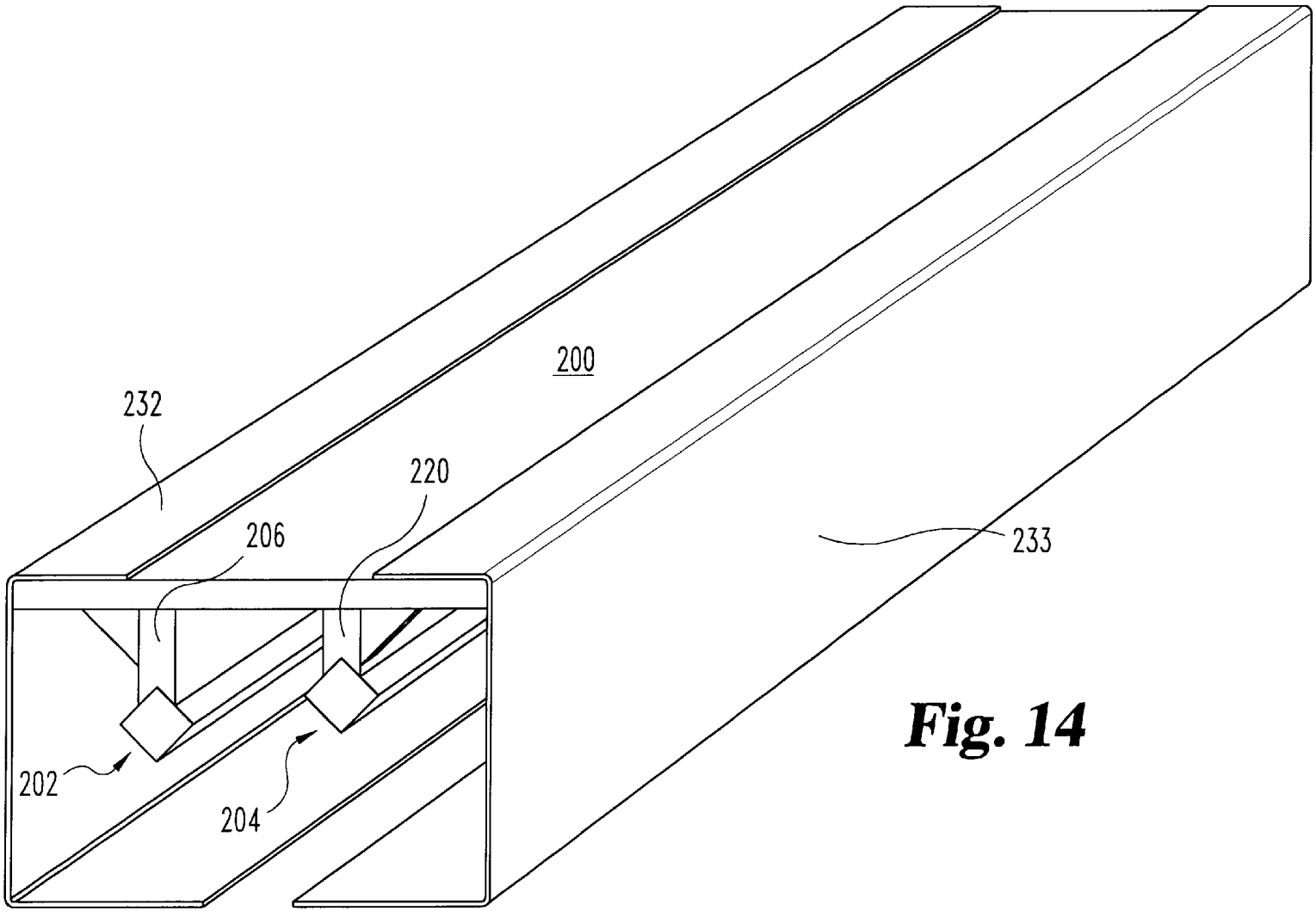
FIG. 14 is a diagrammatic perspective view of the track with soffit of FIG. 13.
Figure 15A:
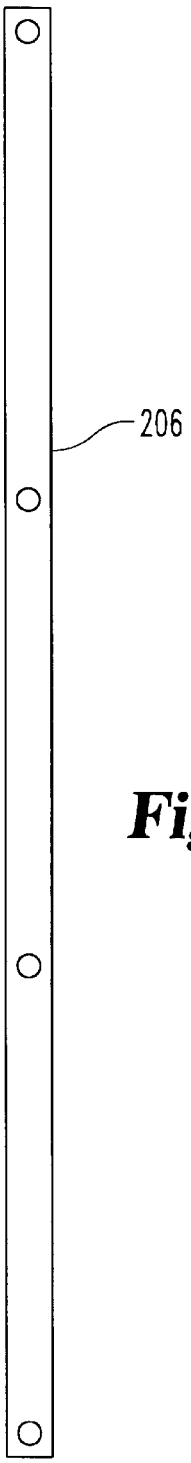
FIGS. 15A and 15B show top and end views of a track long leg.
Figure 15B:
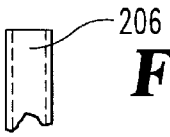
Figure 16A:
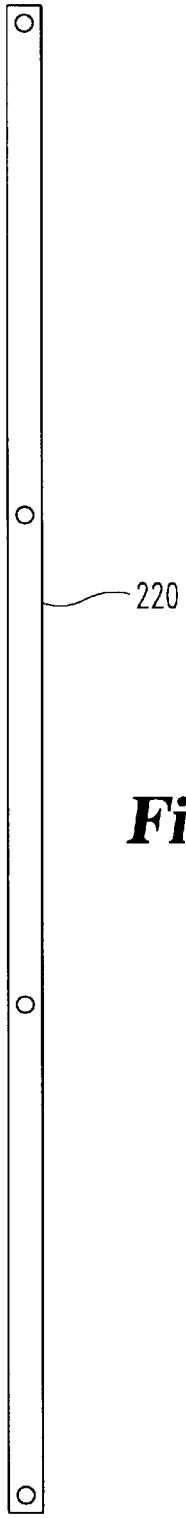
FIGS. 16A and 16B show top and end views of a track short leg.
Figure 16B:
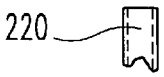
Figure 17:
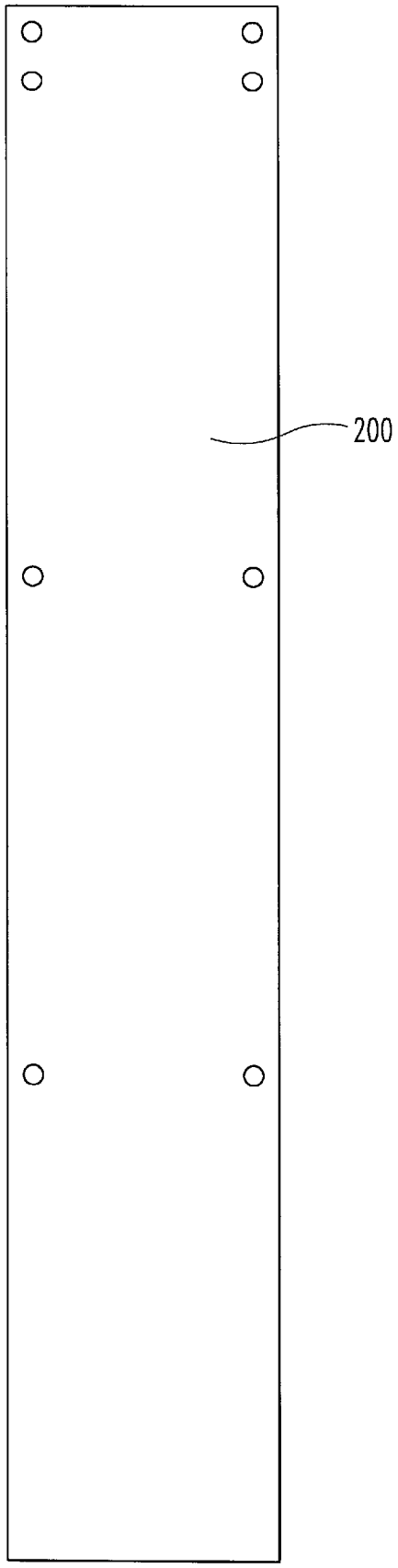
FIG. 17 shows a top view of a track base plate.
Figure 18A:
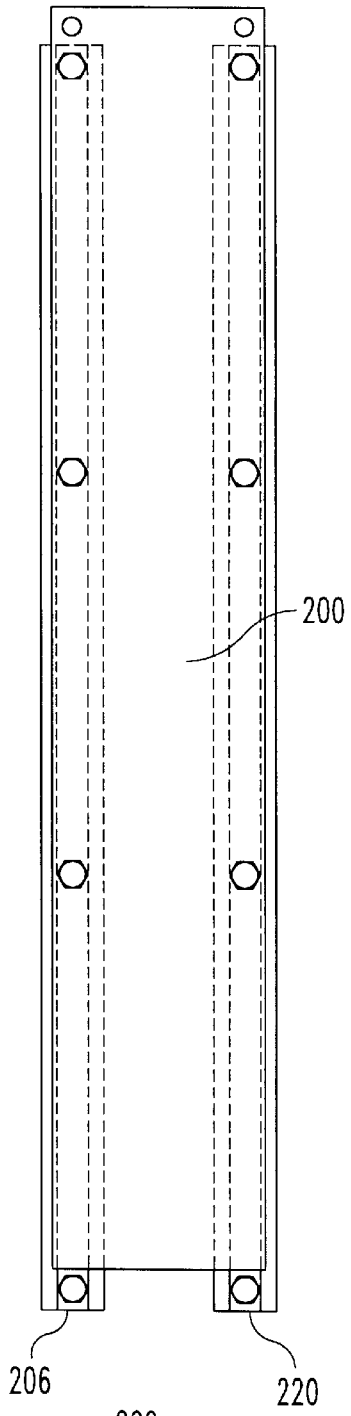
FIGS. 18A and 18B show top and end views of the track after assembly of the base plate with the long and short track legs.
Figure 18B:
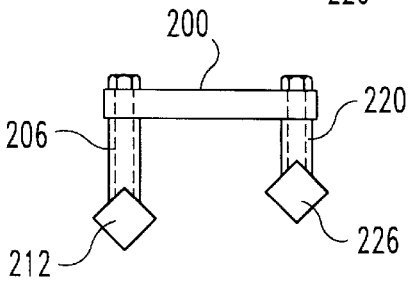

Referring now to FIGS. 13 and 14, there are shown two views of a straight run track with which trolley 170 may be advantageously employed. The track, which generally has the same configuration along its length as shown in FIG. 13, is formed of a steel base plate 200 from which downwardly extends a lower track portion 202 and an upper track portion 204. In FIGS. 17 and 18, base plate 200 is shown having a narrower width, but is otherwise conceptually accurate in these figures. Lower track portion 202, which is also known as the "long leg" due to its greater height than the "short leg" or track portion 204, comprises a milled steel bar 206. Bar 206 is attached to plate 200 through the use of screws 208 that fit into tapped bores spaced along the length of bar 206. Gussets 210 welded between base plate 200 and bar 206 at various locations along the length of the track provide additional strength and rigidity. The bottom edge of long leg bar 206 includes a notch into which nests a corner of a square piece of bar stock 212 made of hardened steel. The inward faces 214 and 216 of bar 212 are engaged by wheel assembly 184 along its circumferential groove during operation. Track bar 212 is welded to bar 206 along the track length. Similar to the structure of lower track portion 202, upper track portion 204 is formed from a milled steel bar 220 attached to plate 200 through longitudinally-spaced screws 222. Gussets 224 achieve additional track strength. The notch in the bottom edge of bar 220 accommodates steel bar 226, which is welded to bar 220. The upper inward face 228 is engaged by the bottom beveled surface of wheel assembly 188 during operation. As shown in FIG. 18A, track bars 206 and 220 project beyond one end of base plate 200, and are recessed from the other base plate end, such that the track bars of each section of track can be attached to the next track base plate in the series, thereby keeping the tracks together without additional fasteners. In alternate embodiments, the long leg and short leg of the track can each be separately formed in one piece, and further the entire track base plate and legs can be formed in one piece of milled steel. Still further, the long and short track legs each can be provided in the form of a downwardly extending bar of flat steel stock to which a steel angle is welded along that bar length. The steel angle is arranged such that its 90 degree point faces inward and one or more of its perpendicular faces are engaged by the outer radial periphery of one of the wheel assemblies of the trolley.

As shown in FIG. 13, trolley 170 suspends an abstractly shown operable wall panel 230 from the track, which track is mounted to the ceiling support structure with not shown hanger rods that extend through holes 213 spaced at intervals along the track length. In this embodiment, the track design that is directly engaged by the hanger rods allows the track top base plate to function as, and in place of, hanger brackets. Soffit panels 232 and 233 are attached to track base plate 200. In operation, trolley 170 moves along the track as wheel assemblies 184 and 188, in a counter-rotating fashion, engage track bars 212 and 226, respectively. Although the track is precision manufactured to closely conform to specifications, it will be appreciated that by having upper track portion 204 not engage the circumferential groove of the wheel assembly 188, the system can better accommodate slight variations in heights between the upper and lower track portions which could otherwise impair trolley motion or damage the track and trolley system.

Figure 19:
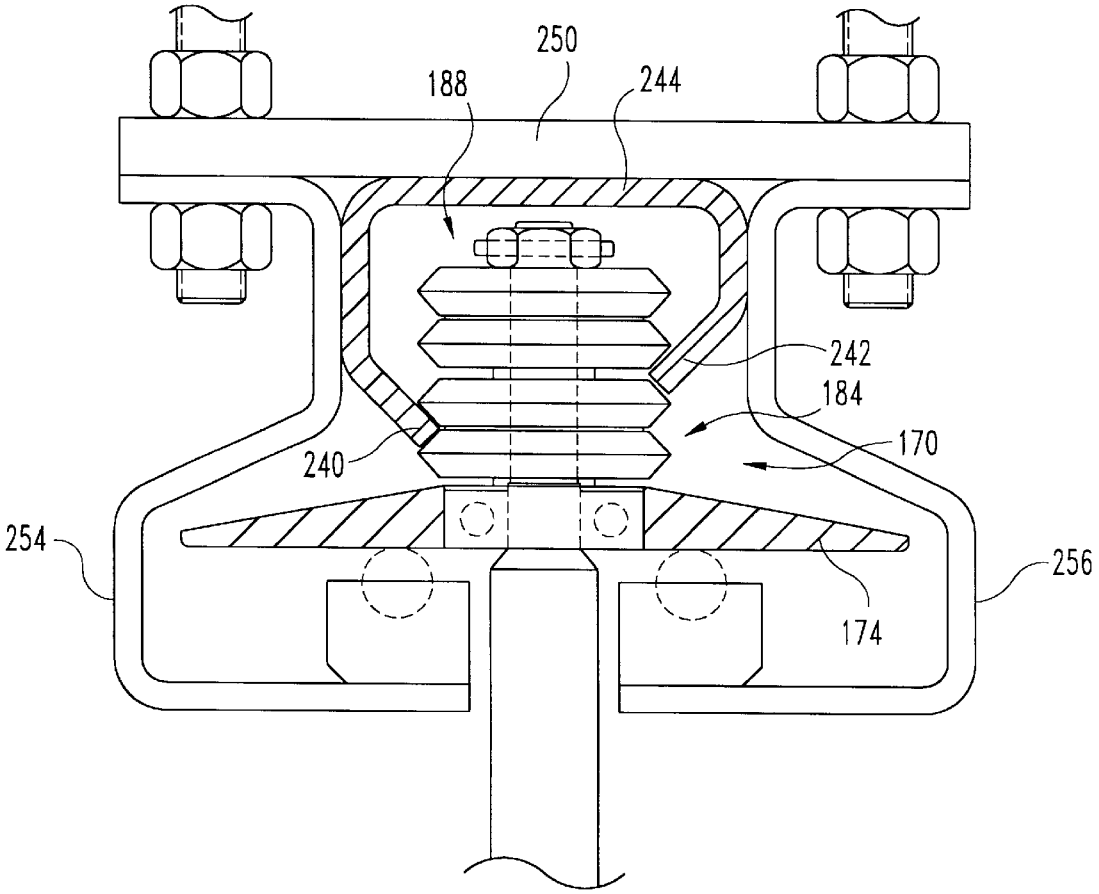
FIG. 19 is a cross-sectional view of an alternate embodiment of a track and trolley of the present invention.

Referring now to FIG. 19, there is shown an alternate embodiment of a track for use with trolley 170. In this embodiment, the track portions that are rollingly engaged by wheel assemblies 184 and 188 are opposite, squared-off edges 240 and 242 of a track member 244 that is formed of hardened, cold-rolled steel as shown. Track member 244 is rigidly secured, such as by welding, to the hanger bracket bar 250, which is attached with hanger rods to the ceiling support in a conventional fashion. The hanger bracket shown in FIG. 19 includes soffit bracket portions 254 and 256, also mounted with the hanger rods. In FIG. 19, the bearing assemblies utilized at the track intersections as described below to engage the underside of steel disc 174 are also diagrammatically shown, but such are not required along the length of the track and are shown herein merely for purposes of explaining how the bearings would be situated should the track extend into the intersections.

Figure 20:
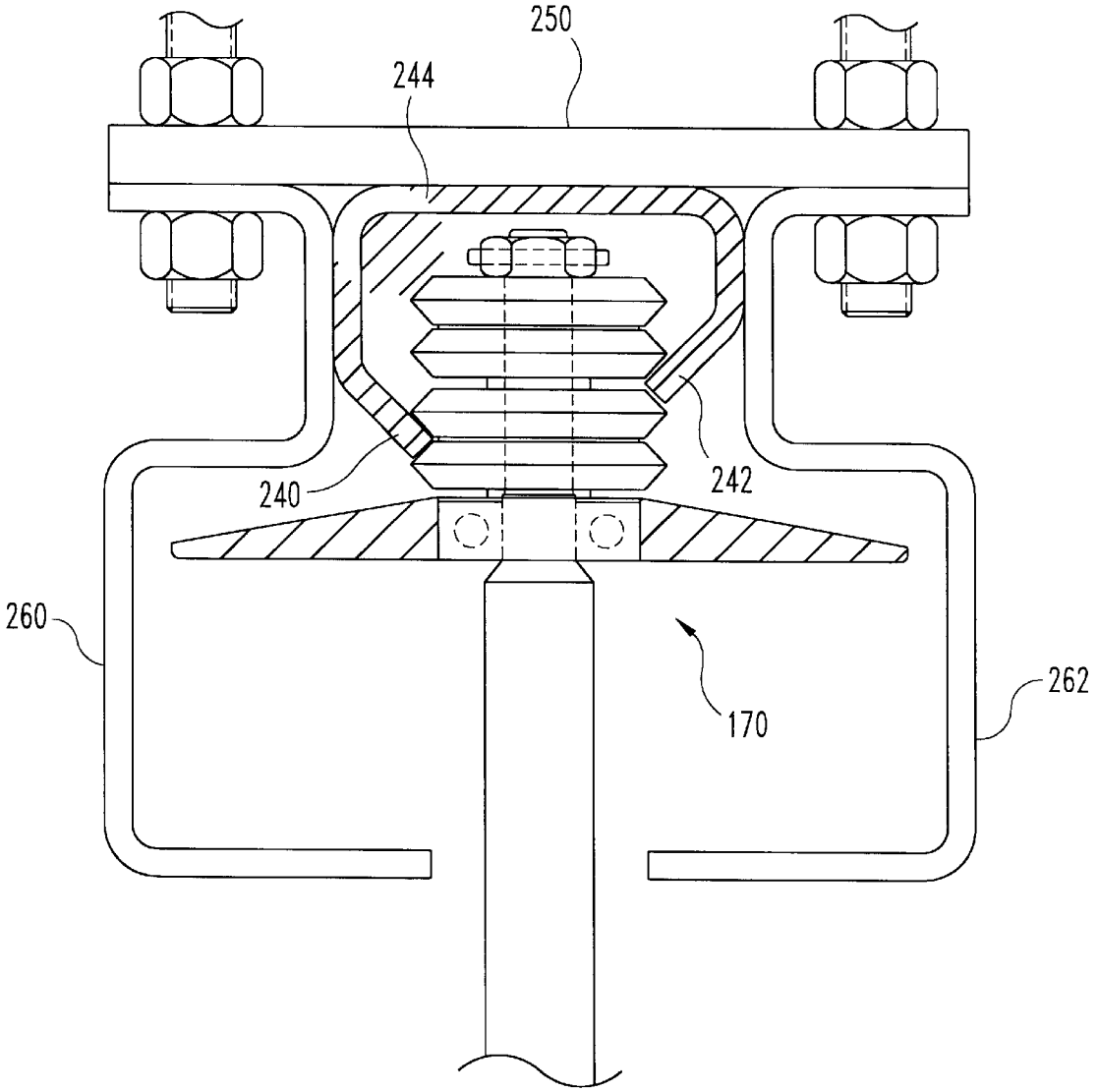
FIG. 20 is a cross-sectional view of an alternate embodiment of a track and trolley of the present invention.

FIG. 20 is a view of another embodiment, in which different soffit brackets 260 and 262 are provided in conjunction with the same hanger bracket bar 250 and track member 244 as shown in FIG. 19.

Figure 21:
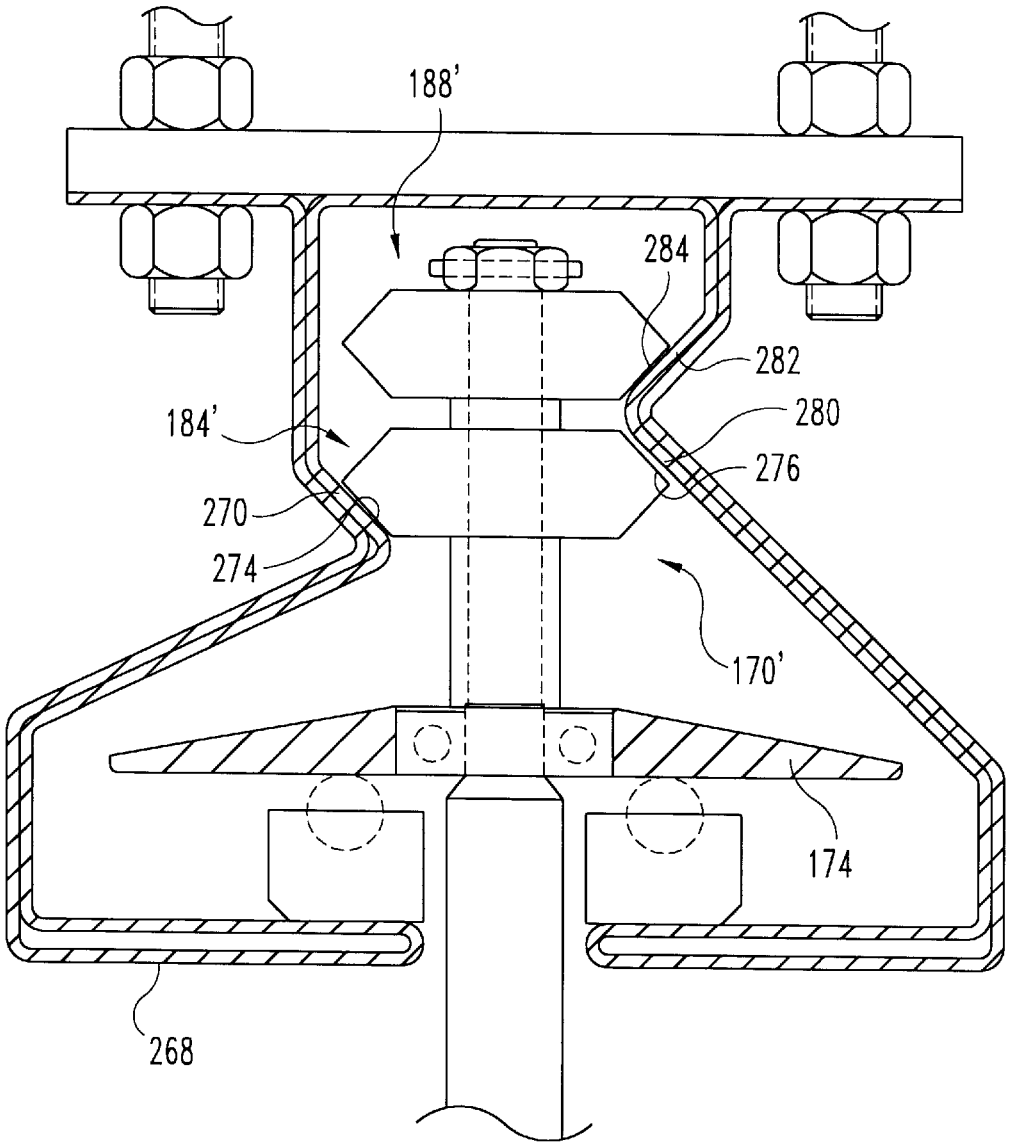
FIG. 21 is an alternate embodiment of a track and trolley system of the present invention.

Referring now to FIG. 21, there is shown an alternate embodiment of a trolley 170', in which the wheel assemblies 184' and 188' have been provided with outer radial peripheries that each have a right triangular convex shape. In this embodiment, the track and soffit are integrally formed from a single piece 268 of extruded material, such as steel. A first angled segment 270 of track piece 268 serves to supportively engage the lower beveled surface 274 of the radial periphery of wheel assembly 184'. Upward vertical movement of trolley 170' is prevented by the abutting engagement of the upper beveled surface 276 of the outer periphery of wheel assembly 184' against the angled track segment 280. An additional angled track segment 282 engages the lower beveled surface 284 of the radial periphery of wheel assembly 188'. The angled track segments are naturally parallel to their respective beveled wheel surfaces, and different angles in the track and wheel peripheries may be employed. In this embodiment, the bearing assemblies utilized to support the steel disc 174 at the intersections described below are illustrated, for the reason listed with respect to FIG. 19.

Figure 22:
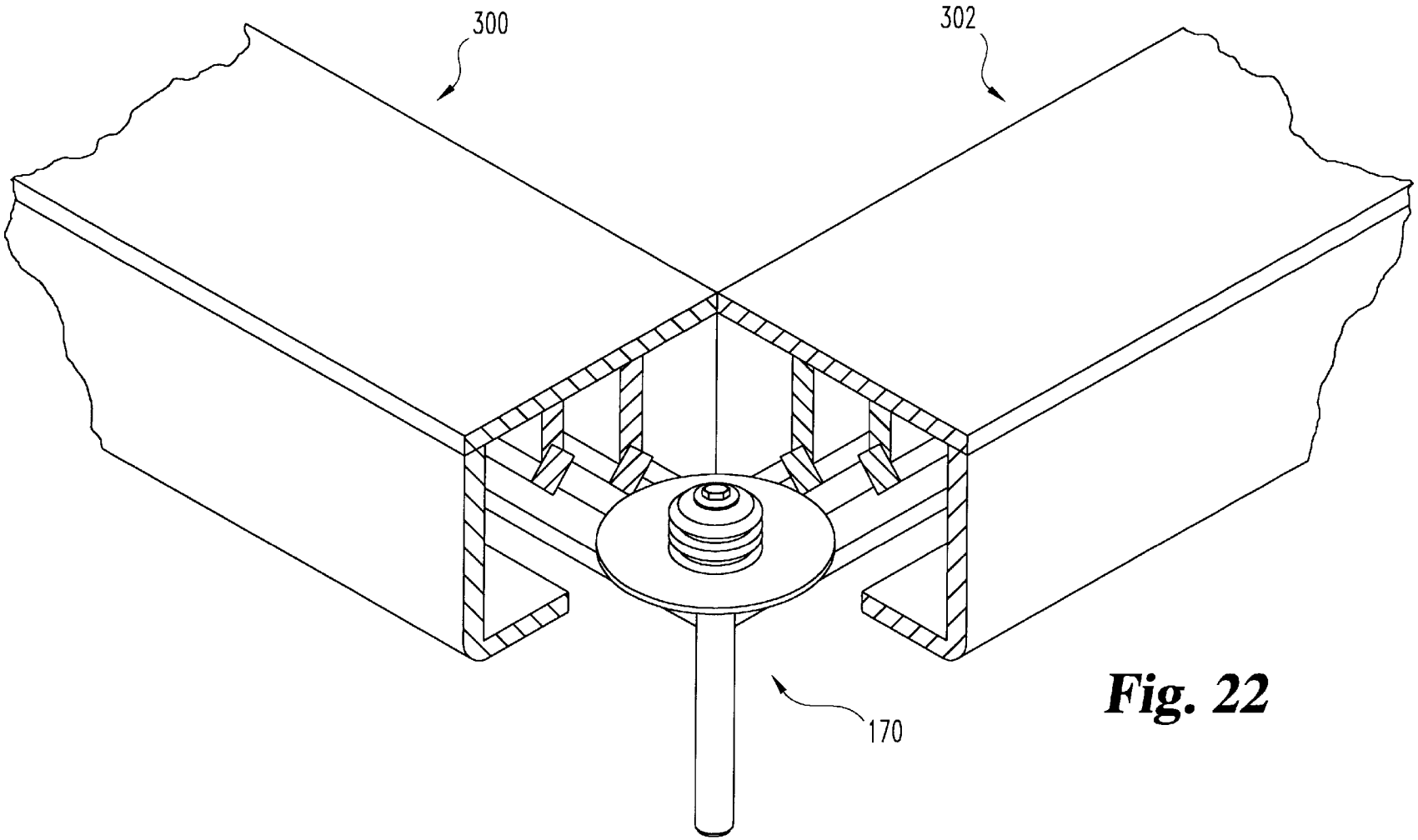
FIG. 22 is a diagrammatic view of a track system employing a ninety degree switch, wherein the trolley is shown within the space normally occupied by the switch which has been cut away.

With additional reference now to FIGS. 22–29, the construction of one track switch, namely an L-intersection or a ninety degree switch, with which trolley 170 finds beneficial application will be further described. FIG. 22 shows a cutaway of a track system employing the inventive switch between straight-run track sections 300 and 302. The ninety degree switch is actually the portion of the track which has been cut away in FIG. 22. With additional reference to FIGS. 24–29, the ninety degree switch includes a steel bottom plate, generally designated 310, provided with multiple holes 312 that are used to install the bearing devices shown in top and front views in FIGS. 25A and 25B. Bores 314 through plate 310 are used to receive the spacer assemblies that attach bottom plate 310 to the remainder of the L-intersection or switch described herein.

Figure 25A:
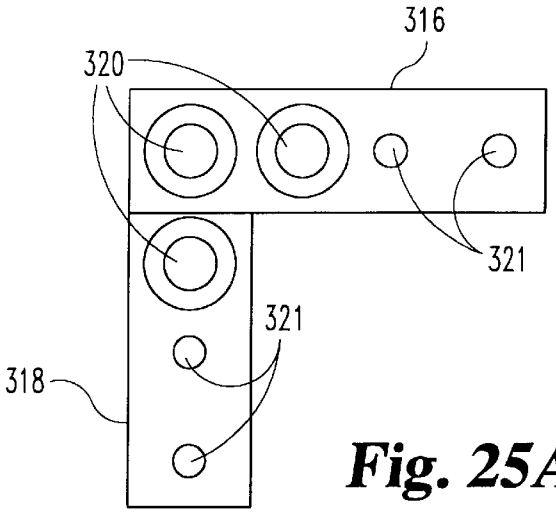
FIGS. 25A and 25B are top and front views of a pair of bearing devices attachable to the upper surface of the bottom plate of FIG. 24.
Figure 25B:
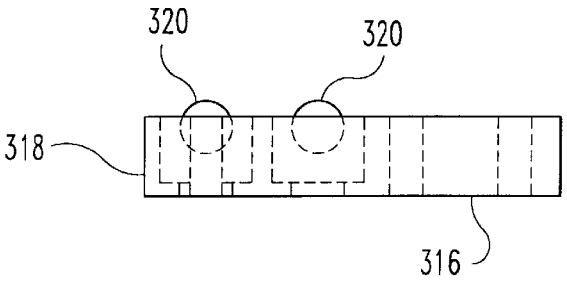
Figure 24:
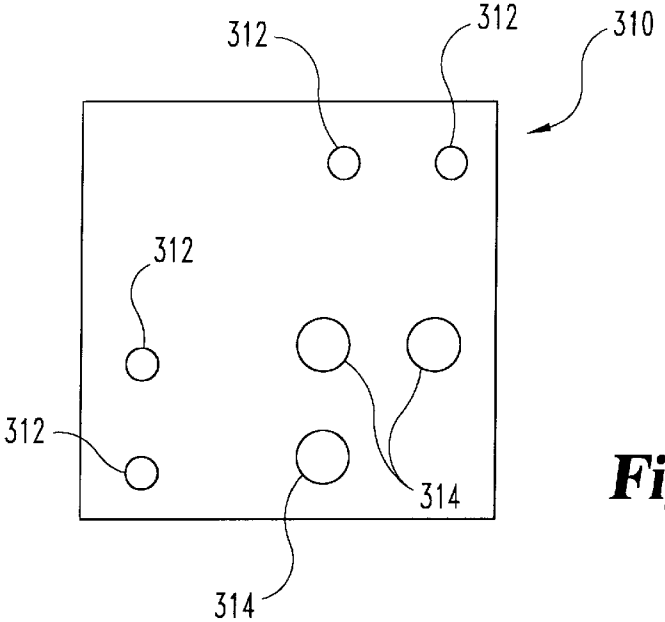
FIG. 24 is a top view of a bottom plate utilized in a ninety degree switch.

With reference to FIGS. 25A and 25B, bearing devices that rollingly support trolley 170 as the trolley moves through the switch and which are installed to bottom plate 310, are further shown. First and second mounting blocks 316 and 318, made of steel or other durable material, are respectively provided with two and one smooth bores therethrough in which are installed bearing assemblies generally indicated at 320. Each bearing assembly 320 includes a trolley disc-engaging ball bearing that protrudes above the top of the blocks 316 and 318. The ball bearings of bearing assemblies 320 are positioned such that the top surface of each is at such a height that it engages the underside of steel disc 174 of trolley 170 when the trolley passes through the switch. This engagement provides for a smooth tracking of the trolley through the switch and functions to support the disc when the trolley wheel assemblies slip out of engagement with the track legs as the trolley enters the comer of the intersecting track lines. While a differently configured bearing may be provided in other known fashions, one suitable bearing is an autotrack ball transfer available from General Bearing Corporation of West Nyack, N.Y. Tapped bores 321 provided in blocks 316 and 318 receive threaded fasteners which are inserted from below through bores 312 provided in base plate 310 to secure the blocks to bottom plate 310.

Figure 27:
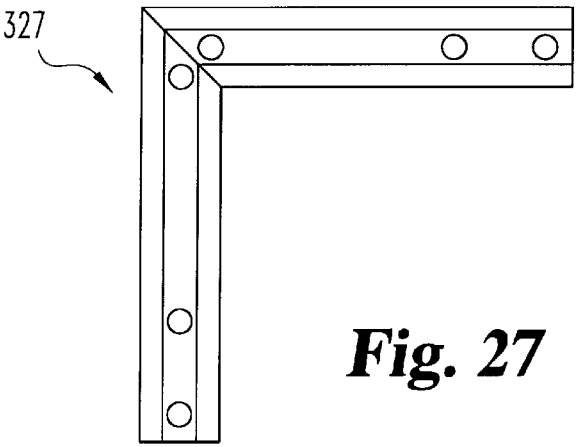
FIG. 27 is top view of an L-shaped section of the "short leg," or higher track running surface the switch.
Figure 26:
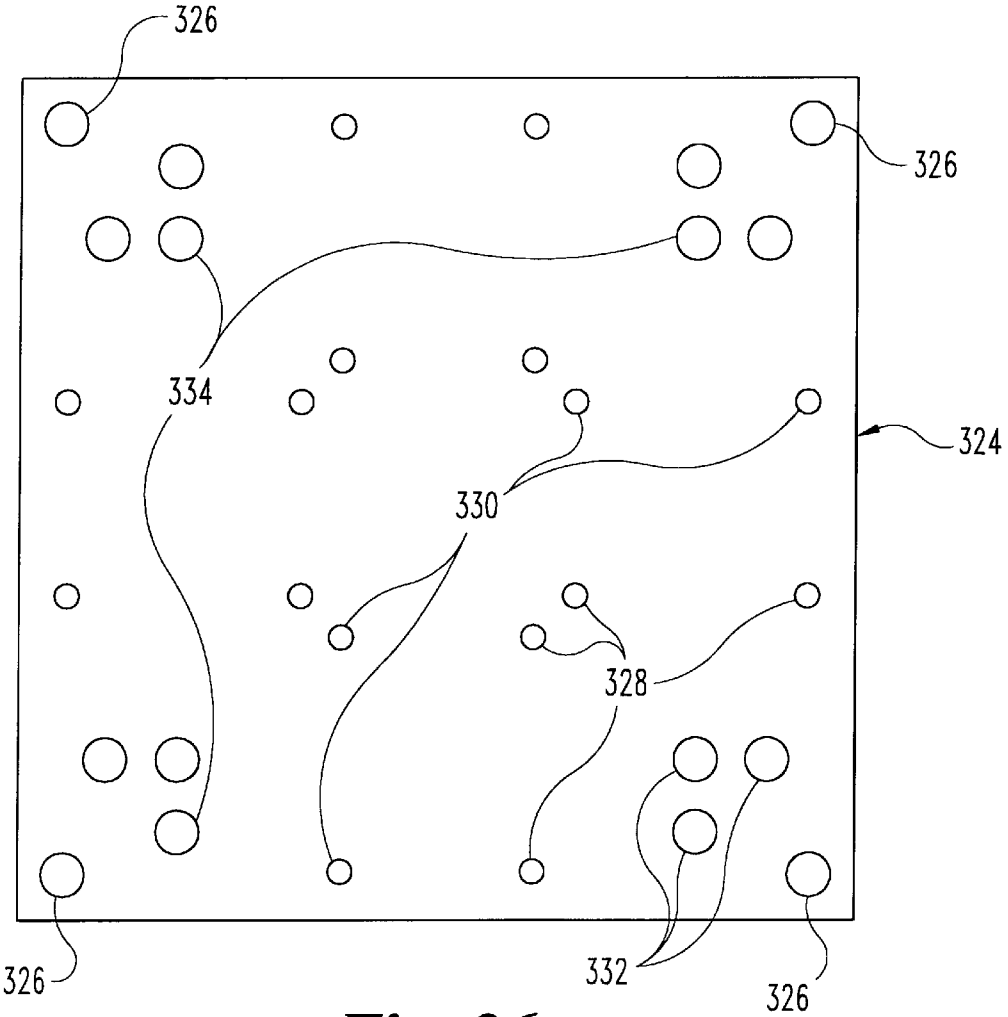
FIG. 26 is a top view of the top plate of a ninety degree switch.
Figure 28:
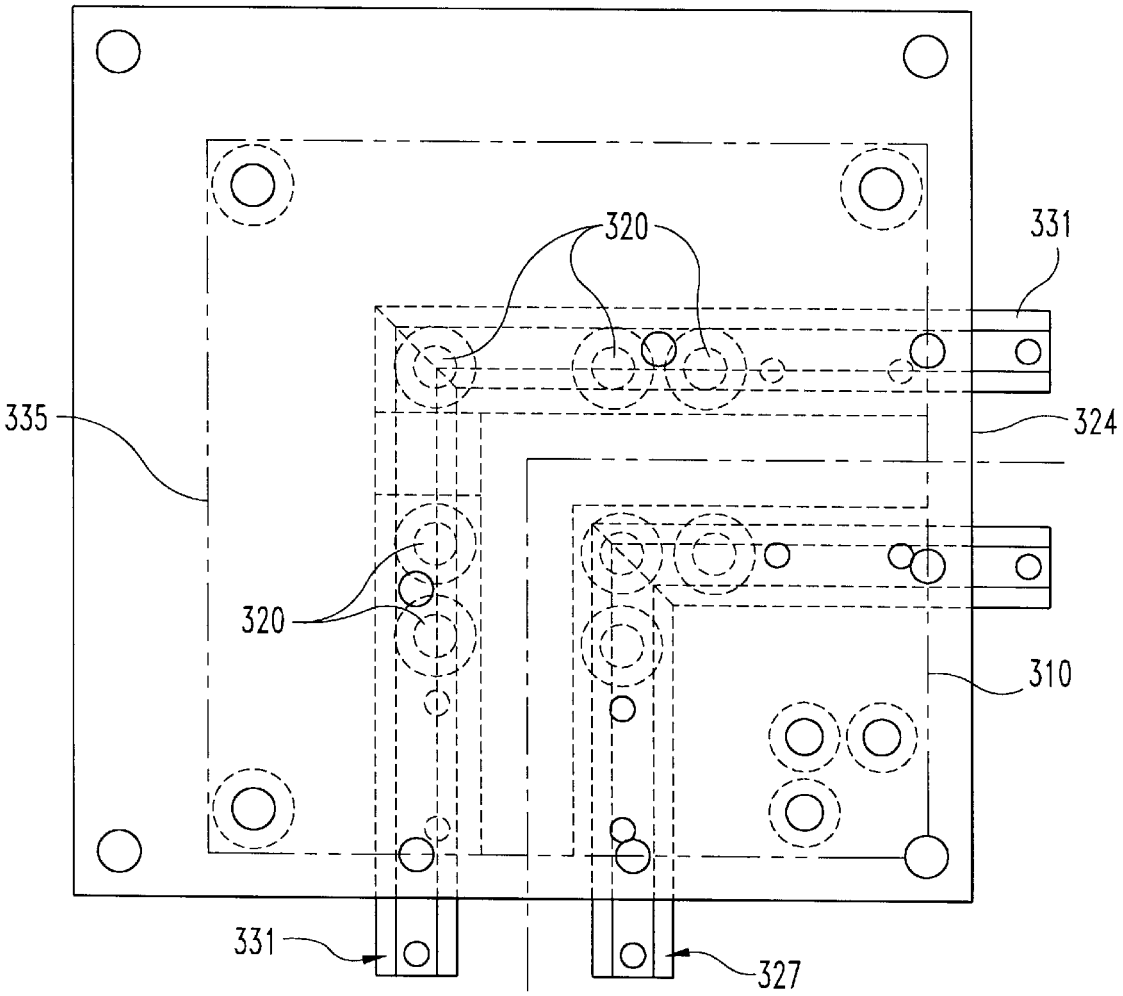
FIG. 28 is a top view showing an assembled switch of the present invention.

Referring now to FIG. 26, there is shown a top view of a steel top plate, generally designated 324, suitable for use in the ninety degree switch. Top plate 324 is shown as being provided with a multitude of smooth bores not identified herein which allow its use with a T-intersection and a X-intersection, as well as this described L-intersection. Top plate 324 includes comer bores 326 that allow the passage of fasteners therethrough to enable mounting of plate 324 to a support structure. A track short leg 327, which is L-shaped as shown in the top view of FIG. 27, is mounted to the underside of top plate 324 through the use of screws that pass through bores 328 through steel plate 324. Holes 330 formed in plate 324 accommodate fasteners from above to mount the L-shaped long leg 331 of the track assembly to top plate 324. Holes 332 are utilized with a spacer assembly (as described below) to rigidly secure bottom plate 310 to top plate 324. Bores 334 accommodate three spacer assemblies utilized to attach the second base plate, generally designated 335, to top plate 324. Second base plate 335, which is shown in top view in FIG. 28, is also provided with a series of bearing devices that furnish five additional bearing assemblies 320 to support the trolley during the track switch passage. As shown in the front view of FIG. 29, each spacer assembly is comprised of a steel spacer tube 337 which is sandwiched between top plate 324 and either bottom plate 310 or bottom plate 335 through the use of bolts 340 that pass through the bores in the sandwiching top and bottom plates, through the internal hollow of the spacers, and that are attached with nuts 342. The spacer tubes are of a proper height to cause the bearing assemblies and the track legs to be at heights to allow engagement with the trolley disc and wheels, respectively.

Figure 23:
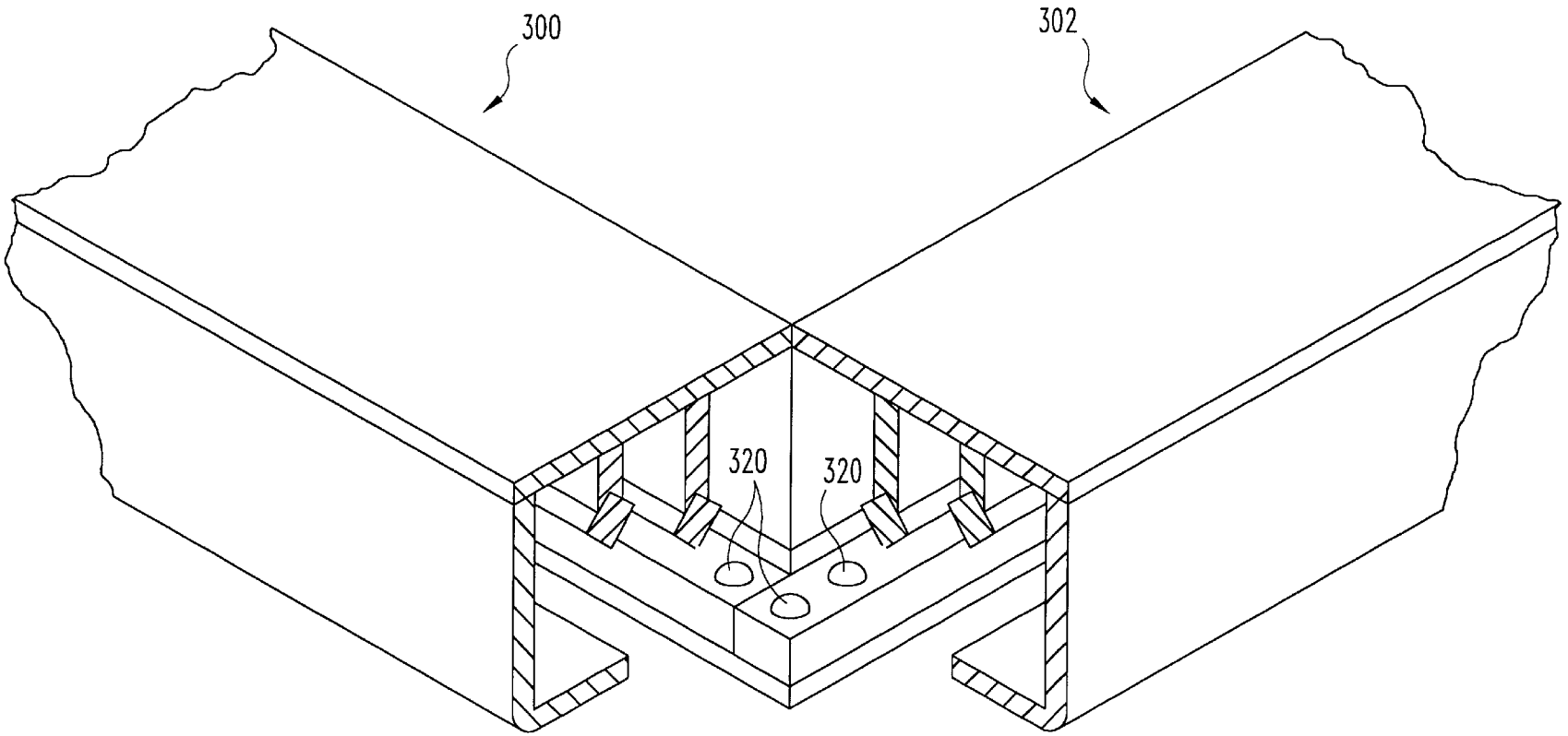
FIG. 23 is a view similar to FIG. 22 in which the trolley has been removed in order to show of the bearings utilized within the partially visible track switch.
Figure 29:
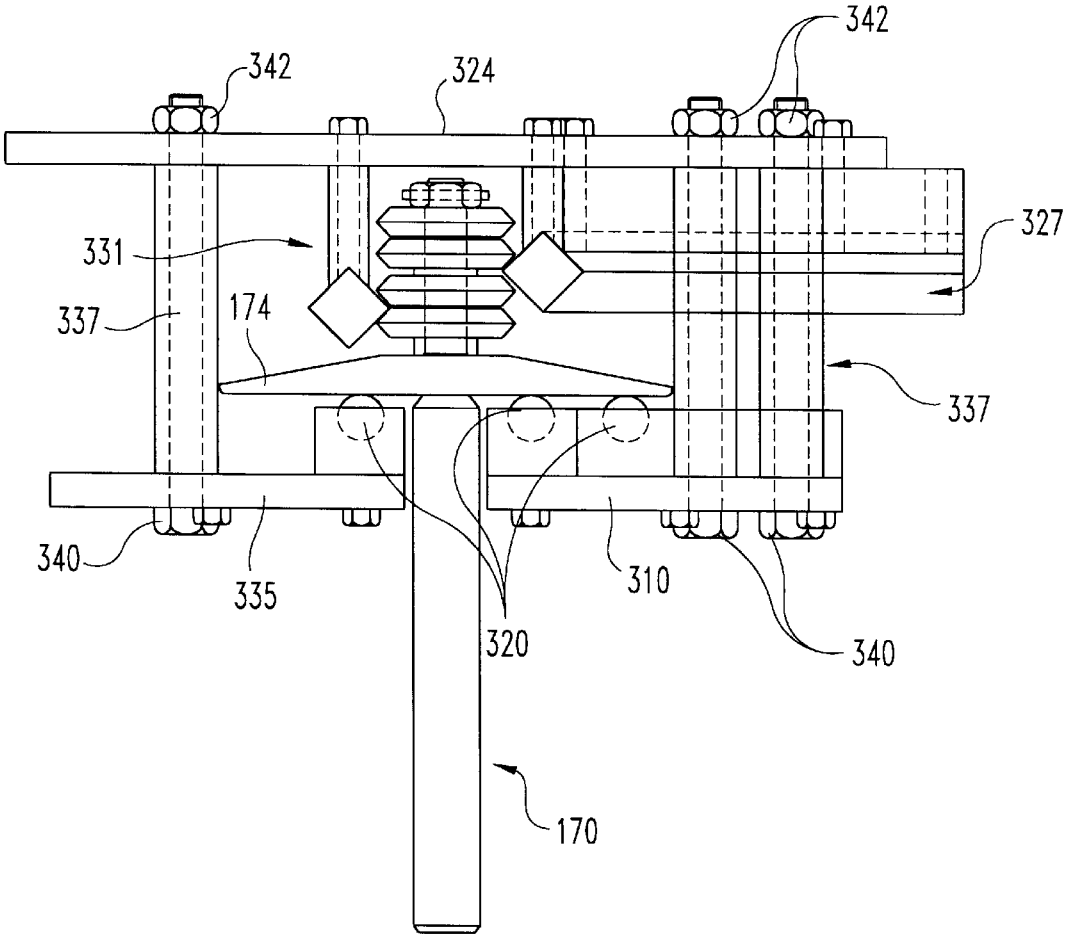
FIG. 29 is a front view of the switch of FIG. 28, wherein the trolley is also shown running therethrough.

It will be appreciated that the ninety degree switch shown in FIGS. 24–29 is not exactly suitable for use in the track of FIG. 22 due to the fact that the track short leg and the track long leg in the switch of FIG. 29 are reversed from the arrangement required for use with tracks 300 and 302 of FIGS. 22 and 23. In other words, the short leg in the track switch section must abut the short legs provided in the straight track sections to which it is connected, and the long legs must abut, so that track segments of continuous height along both sides of the trolley are provided.

Figure 30:
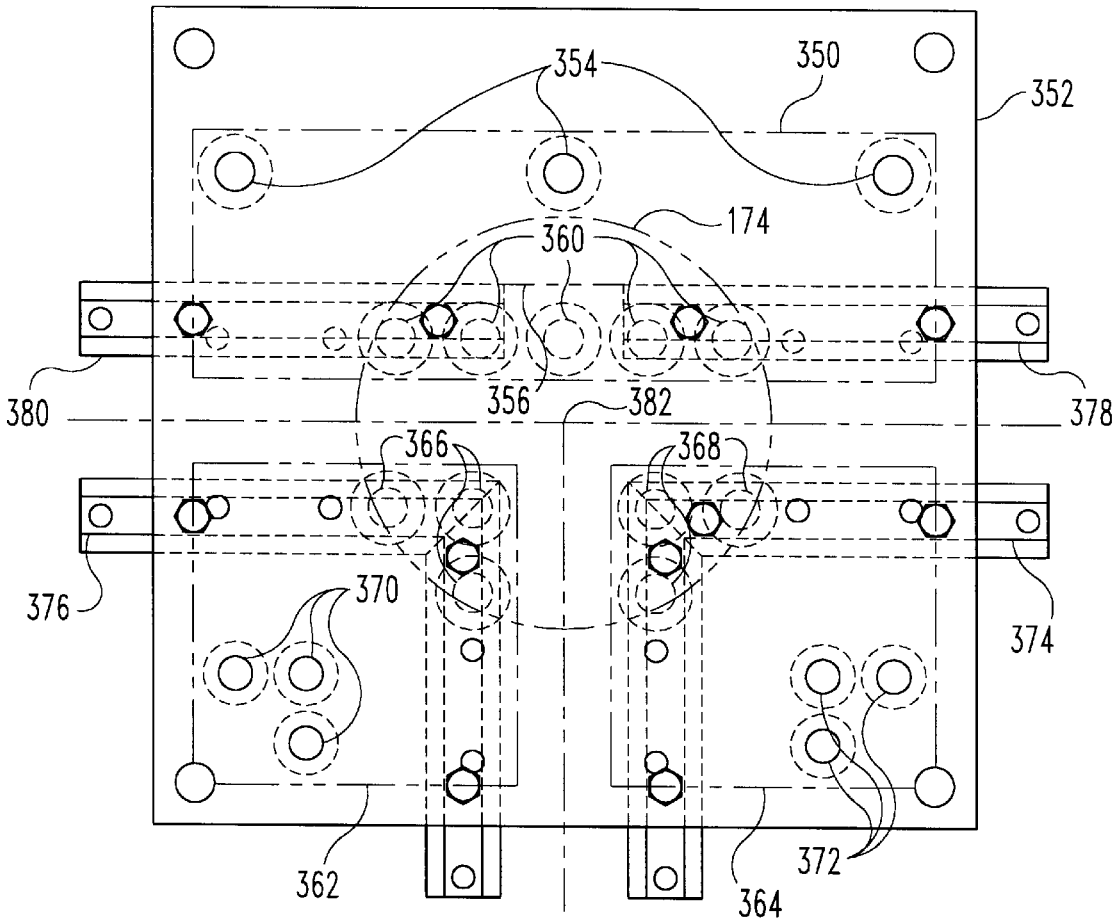
FIG. 30 is a top view of a T-intersection of the present invention.
Figure 31:
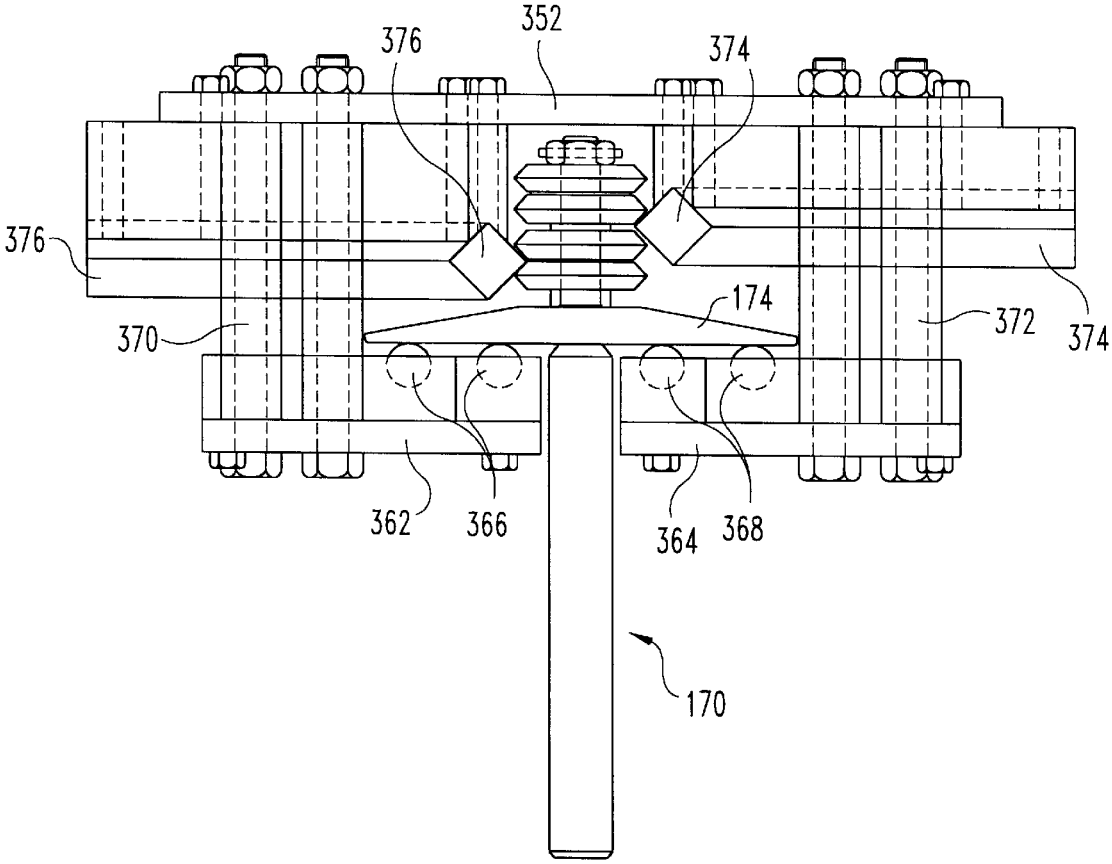
FIG. 31 is a front view of the T-intersection of FIG. 30.

Referring now to FIGS. 30 and 31, there are shown a top and a front view of a T-intersection or switch of the present invention to which three straight track sections (not shown) are attached. A rectangular, steel bottom plate 350 is connected to top plate 352 in spaced-apart relationship therewith by means of three spacer assemblies indicated generally at 354. A straight, bearing mounting block 356 is fastened with screws to the top surface of bottom plate 350 and is provided with five trolley-disc-engaging bearing assemblies 360 evenly spaced along the middle length section of block 356. Mirror image bottom plates 362 and 364 are each equipped with three bearing assemblies, namely bearing assemblies 366 and bearing assemblies 368, respectively, and are respectively mounted to top plate 352 in spaced-apart relationship therewith by spacer assemblies indicated generally at 370 and 372.

Bearing assemblies 360, 366 and 368 serve to support, and allow smooth tracking of, the trolley as it enters the intersection of the track lines. In particular, these bearing assemblies are arranged such that the trolley disc 174, which is shown in dashed lines in FIG. 30, engages the bearing assemblies at the point of track intersection at which the wheel assemblies are no longer in engagement with the track legs.

An L-shaped track leg 374 is a short leg, and L-shaped track leg 376 is a long leg in order to work optimally with a short leg for track leg 374. Each of track legs 374 and 376 is attached to the underside of top plate 352 with threaded fasteners. A straight section of a track long leg 378 is provided across from short leg 374, such that when the trolley is disposed directly between track legs 374 and 378, both a short leg and a long leg of track are provided for engagement with the different height wheel assemblies of the trolley. In a related fashion, and complementary to long leg 376, track leg 380 is a short leg in order to provide different height track sections within the track section leading off to the left from FIG. 30. Track legs 380 and 378 are spaced from each other along their axial lengths such that neither engages the wheel assemblies of the trolley when the trolley reaches the point of intersection 382.

Figure 32:
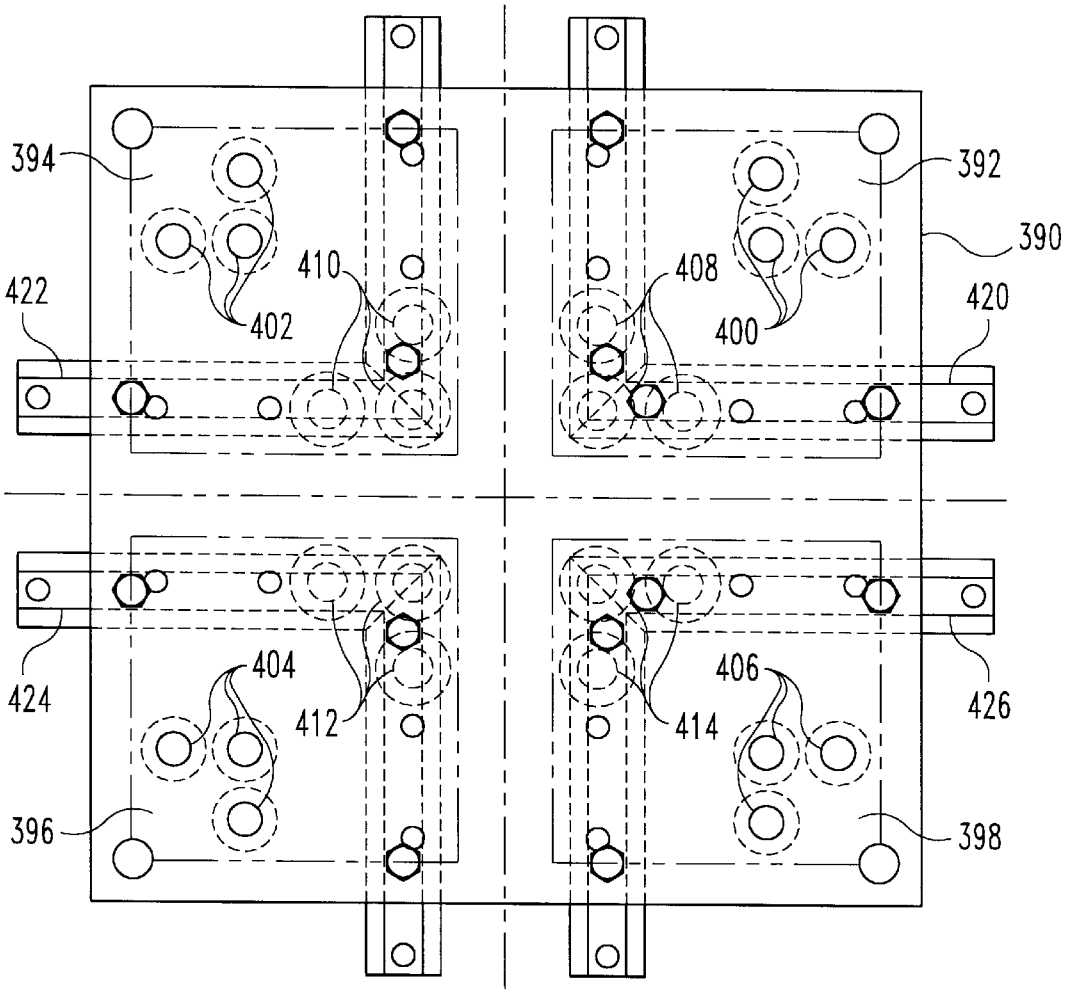
FIG. 32 is a top view of an X-intersection of the present invention.
Figure 33:
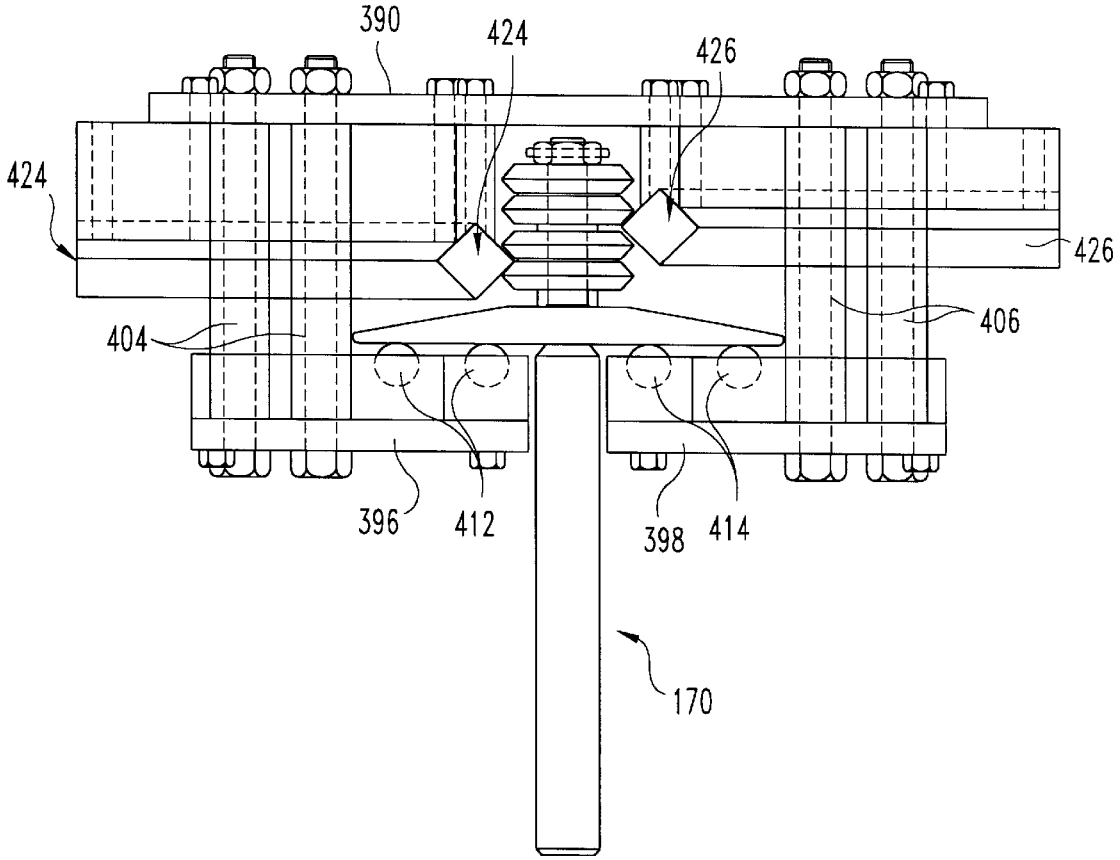
FIG. 33 is a front view of the X-intersection of FIG. 32.

Referring now to FIGS. 32 and 33, there are shown a top and front view of an X-intersection or switch of the present invention to which four not shown orthogonally configured track sections may be attached. Four bottom plates 392, 394, 396, 398 are mounted to top plate 390 in spaced-apart relationship therewith by spacer assemblies indicated generally at 400, 402, 404 and 406, respectively. Bearing devices providing three bearing assemblies, namely bearing assemblies 408, 410, 412 and 414, are furnished on the four base plates. The bearing assemblies support the trolley disc 174, which is abstractly shown in FIG. 34, at the point of intersection. A first L-shaped track leg 420, which is a long leg in that it extends below top plate 390 a greater distance than the short legs, is attached to the underside of top plate 390. A second, L-shaped long leg 424 is attached to the underside of top plate 390 diagonally opposite to leg 420. A pair of short track legs 422, 426 are attached to the underside of diagonally opposite portions of top plate 390. It will be appreciated that at points within the switch between facing track legs, the trolley will always be between short and long track legs such that each of the wheel assemblies can be engaged by one of the track legs. Both ends of each of the track legs 420, 422, 424 and 426 project beyond the periphery of top plate 390 and can be attached to the base plates of adjacent track sections to which the intersection is connected.

Figure 34:
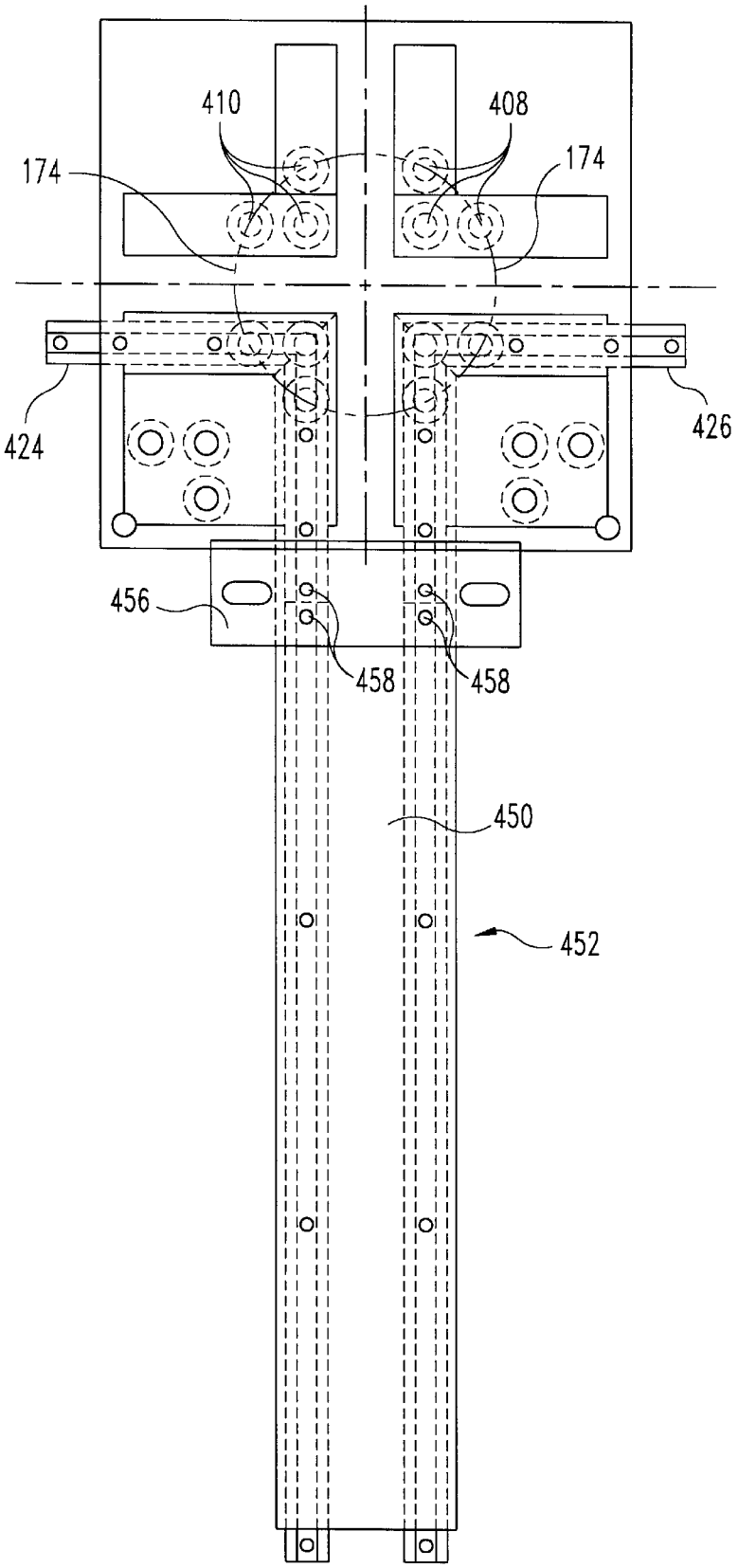
FIG. 34 is a top view of the X-intersection of FIG. 32, wherein portions of the track and various bottom plates are not shown for purposes of illustration, and wherein a straight track section is shown attached to one of the four perpendicular runs of the intersection.
Figure 35:
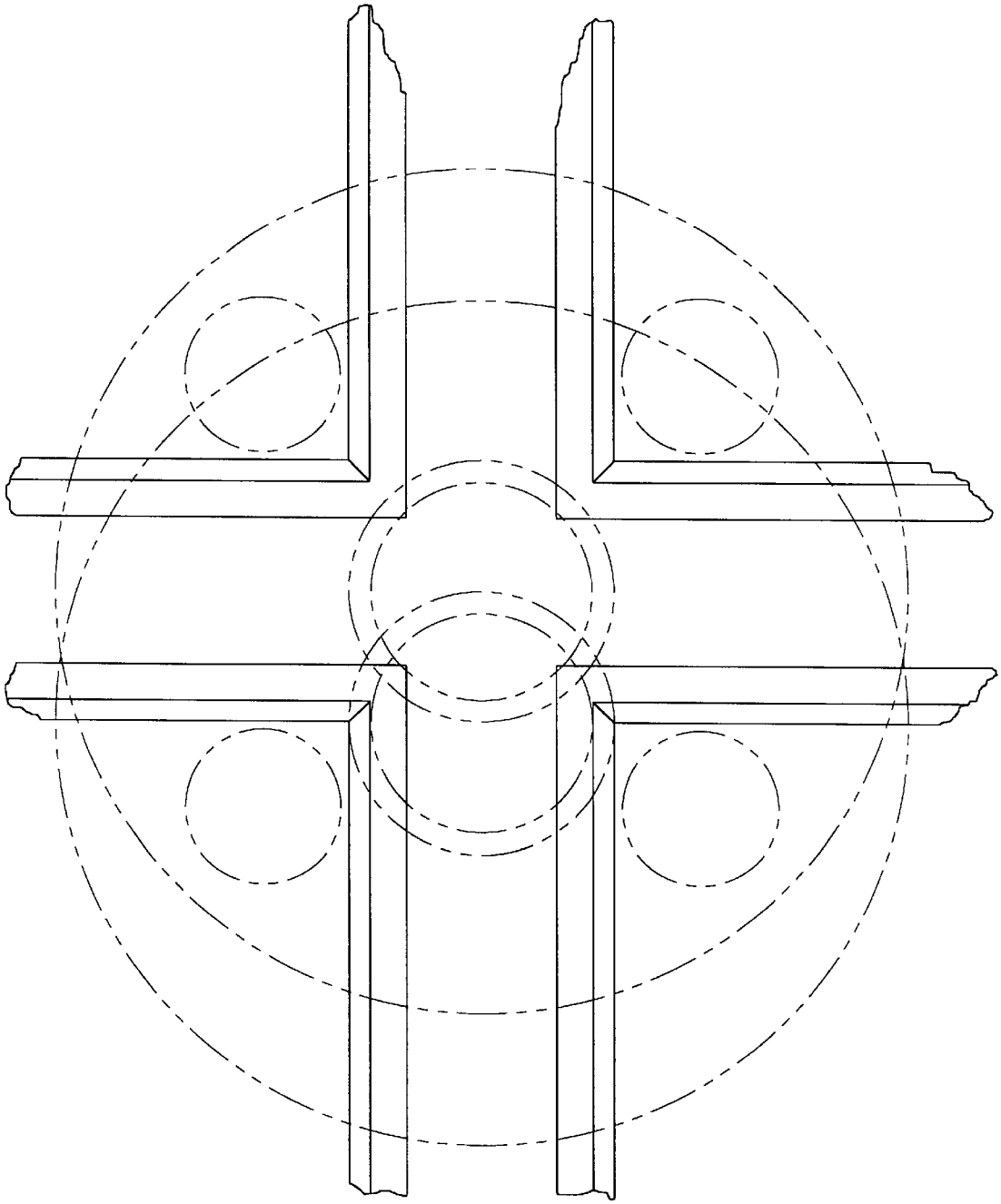
FIGS. 35–42 are diagrammatic top views of alternate bearing configurations.
Figure 36:
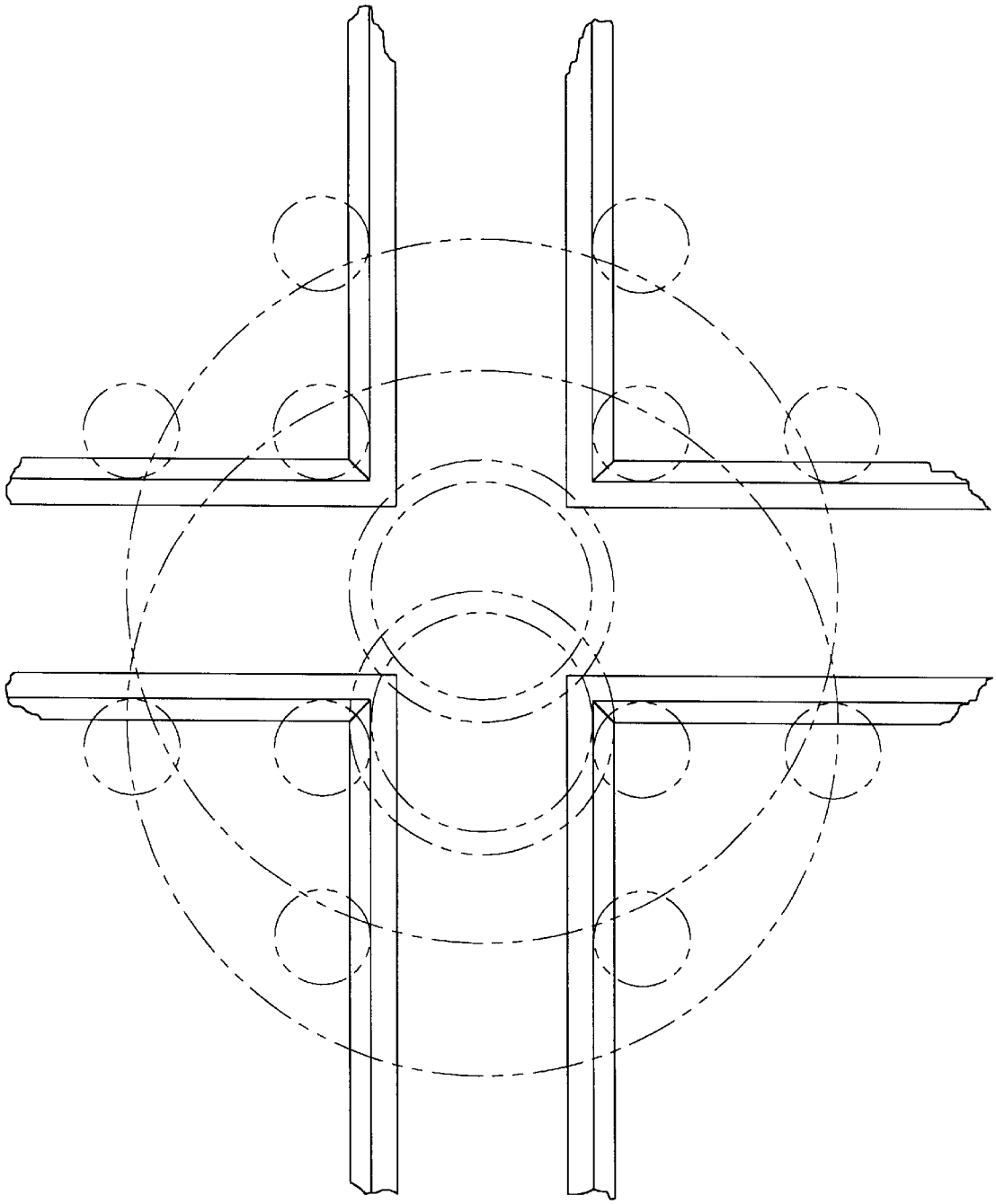
Figure 37:
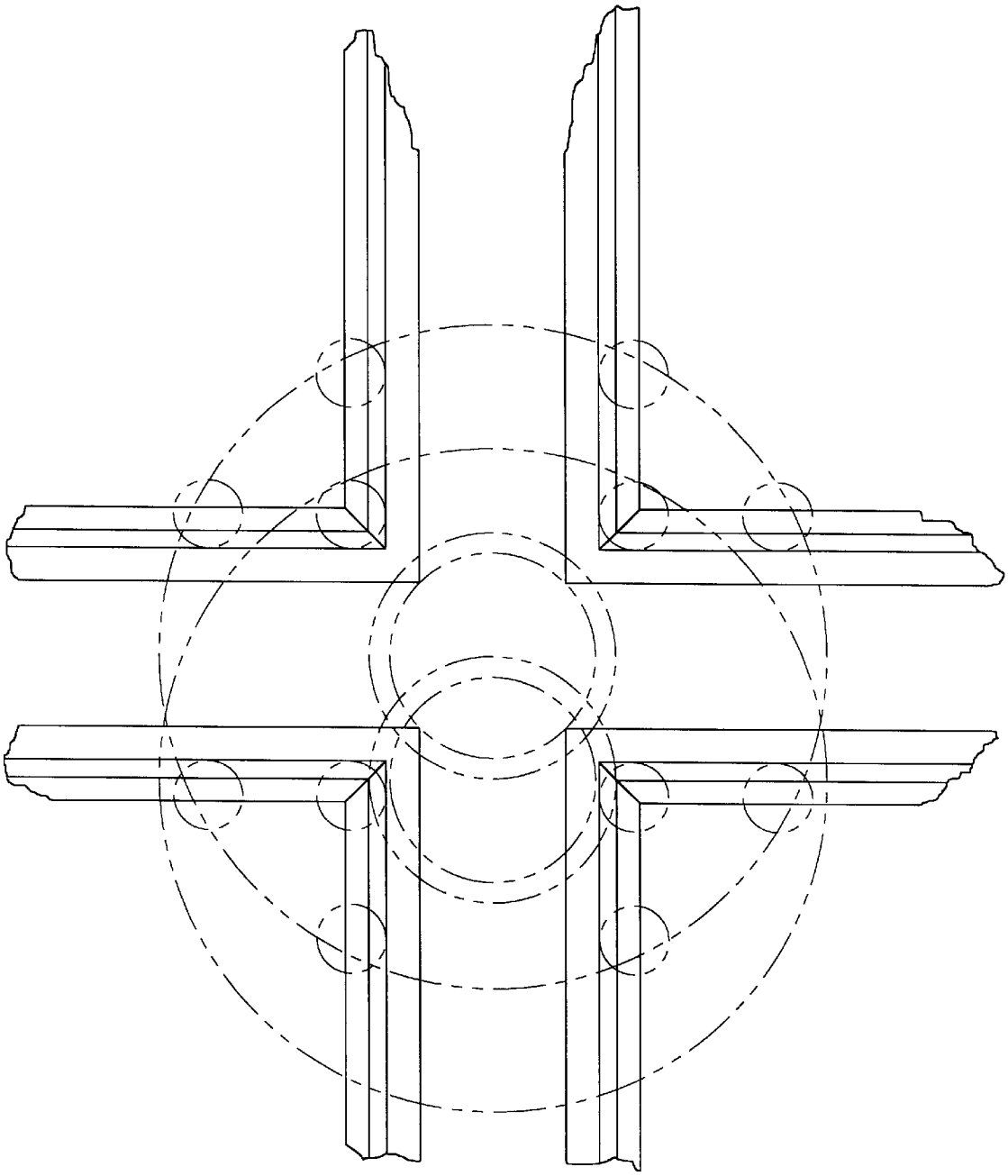
Figure 38:
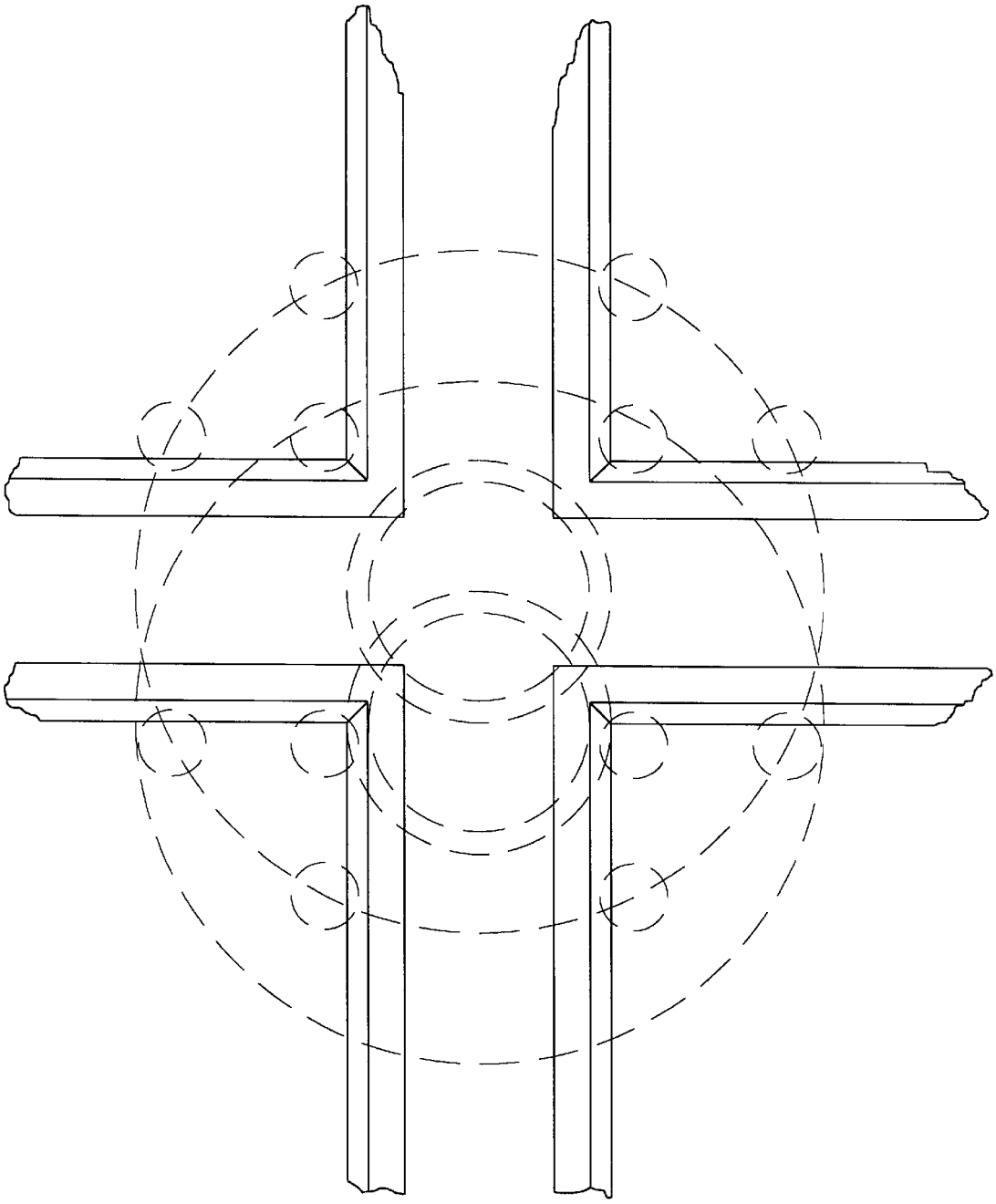
Figure 39:
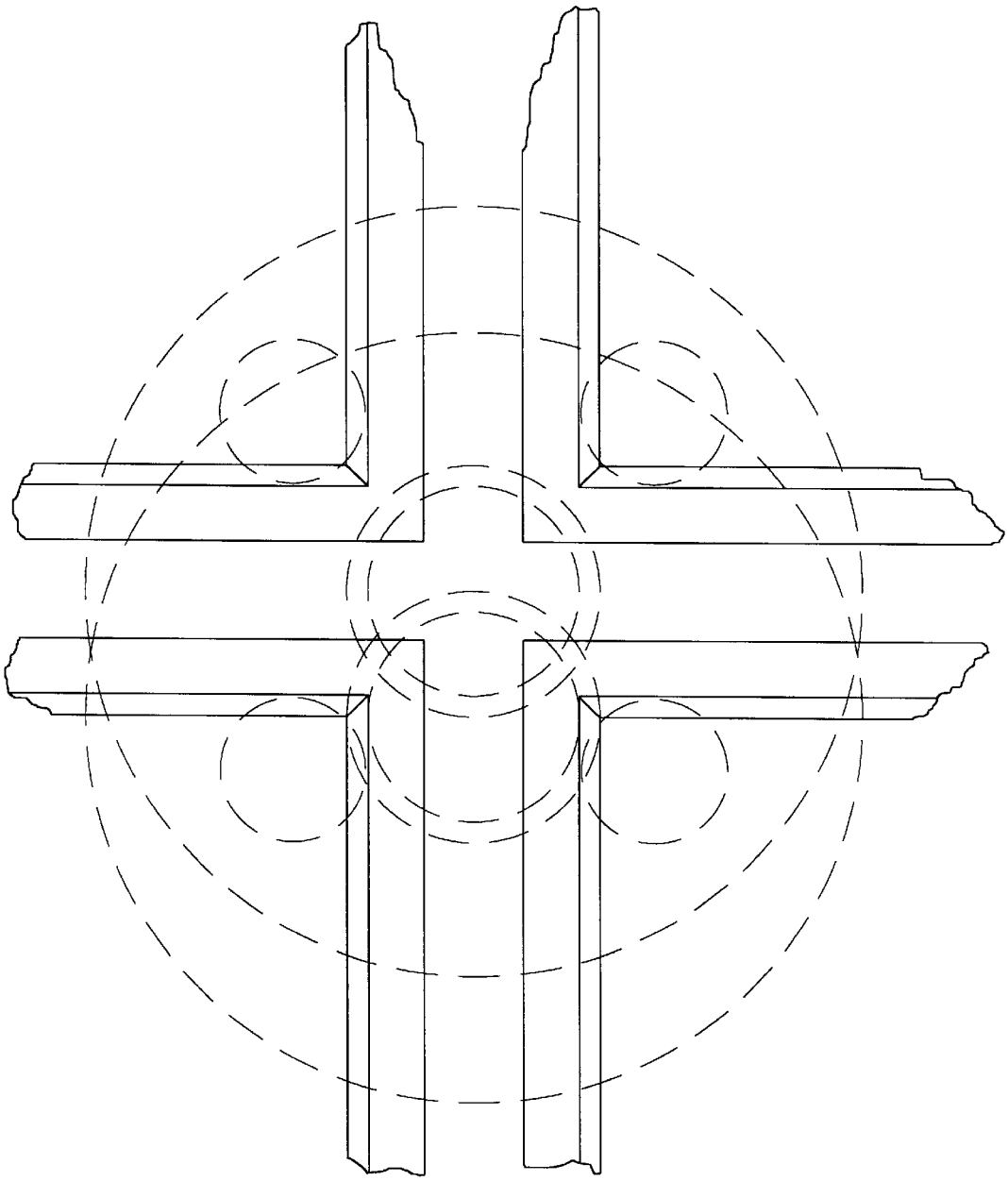
Figure 40:
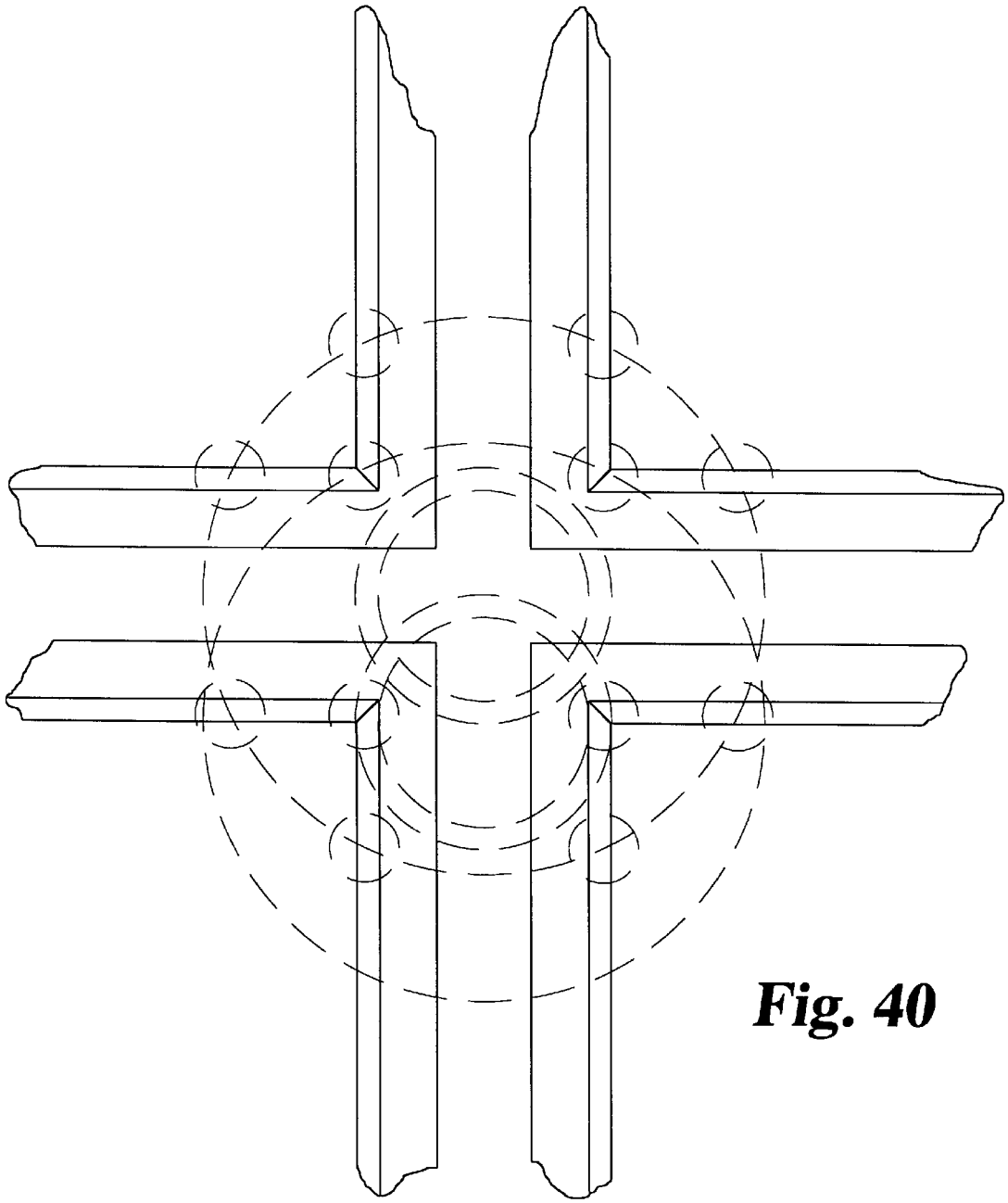
Figure 41:
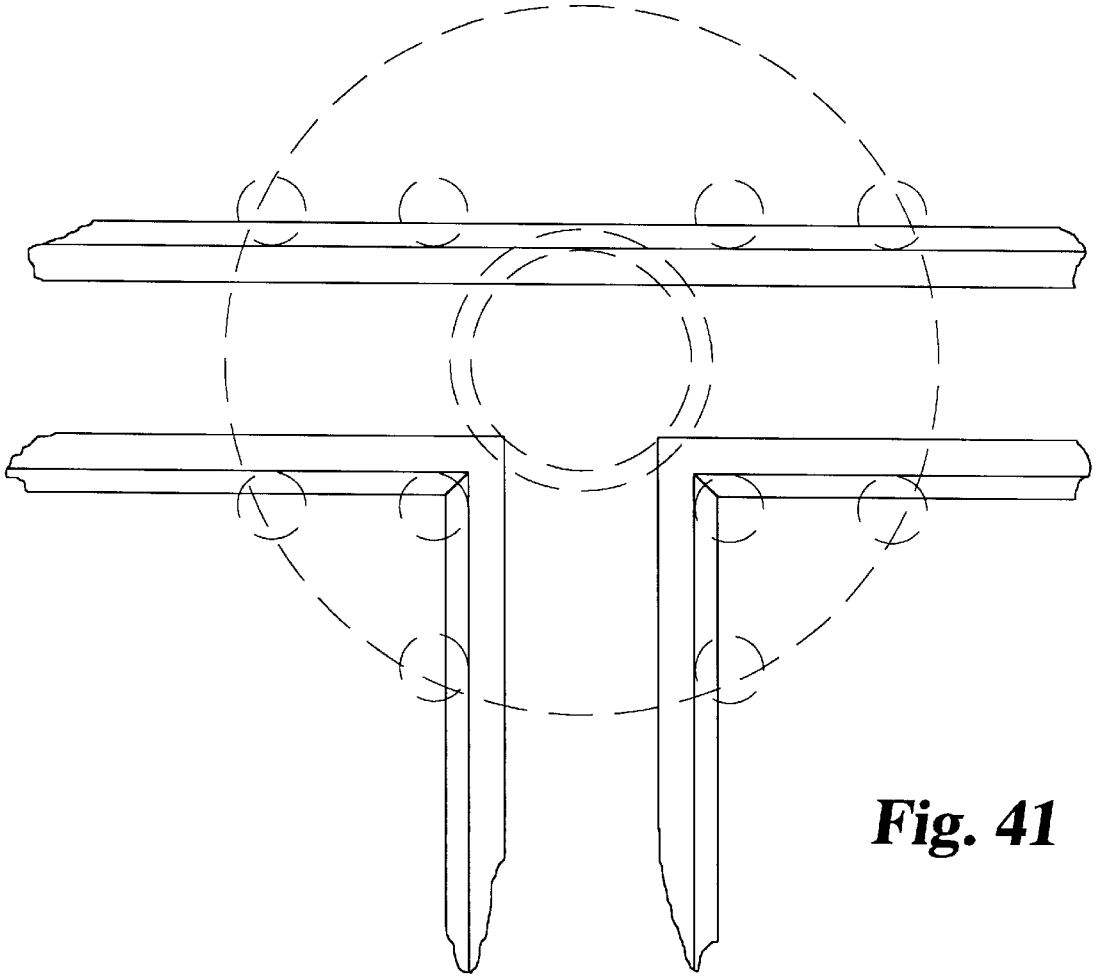
Figure 42:
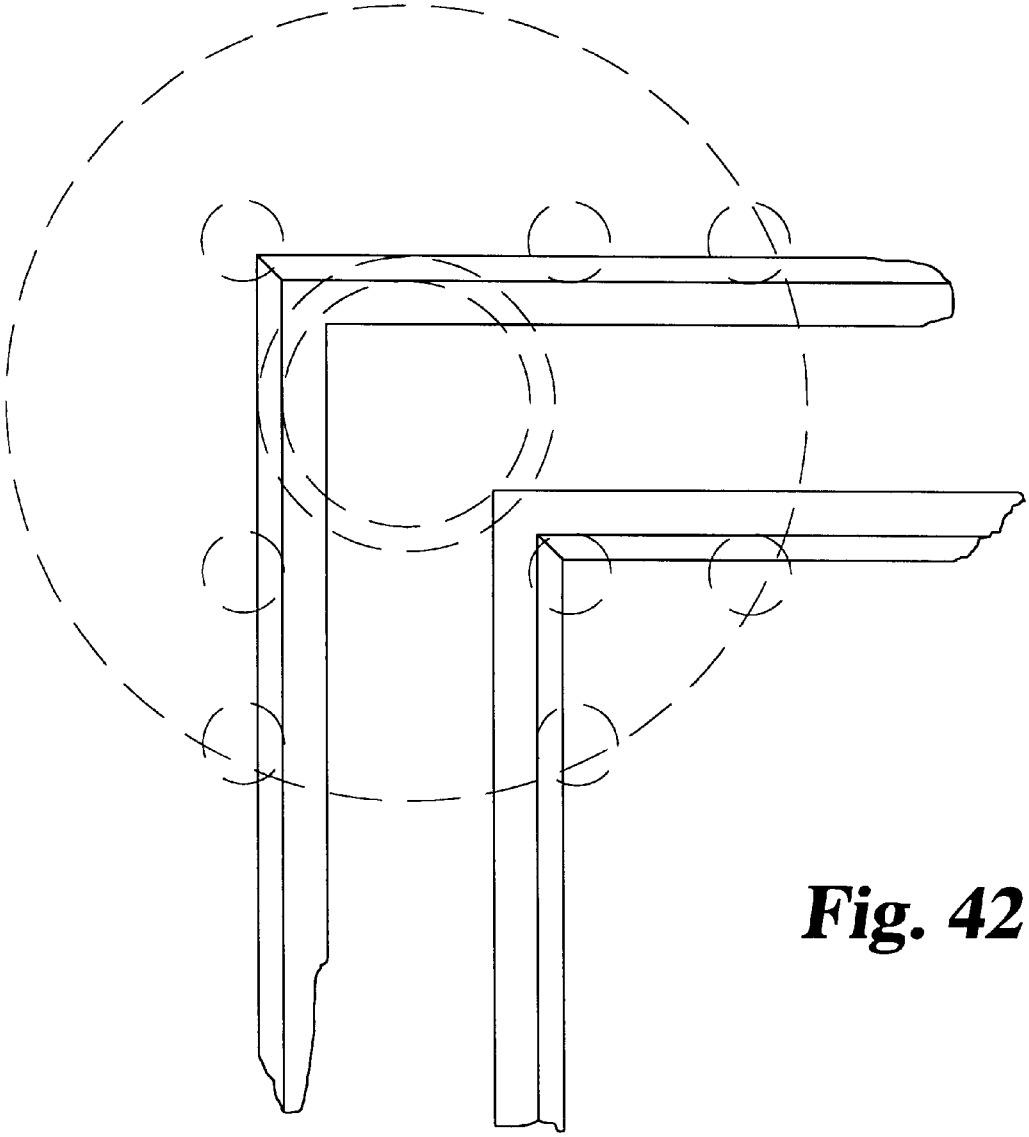

Referring now to FIG. 34, there is shown a top view of the X-intersection of FIG. 32, wherein certain of the track legs and bottom plates to which the shown bearing assemblies are attached are not shown for purposes of illustration. FIG. 34 also further illustrates the manner of connection of the extensions of track legs 424, 426 to plate 450 of the track section 452. In this assembly, the hanger bracket 456 utilized to mount the track sections to a ceiling support is attached to the end of the track with four socket head cap screws 458 that further function to engage the track legs disposed thereunder.

In an alternate embodiment of an X-intersection not shown, rather than providing a separate switch equipped with four L-shaped runs of track (420, 422, 424, 426), or more particularly two diagonally opposed short legs and two diagonally opposed long legs, the track intersection can be formed by intersecting four straight run sections of track, the corners of each intersecting end of each section of the track being mitered at a 45 degree angle so as to properly mate with the mitered corners of track sections disposed 90 degrees relative thereto. The ball bearing assemblies for the trolley disc may be provided on bearing devices fastened to four bottom plates attached to a top plate in a similar fashion to that shown in FIG. 32, which top plate is then mounted over the four intersecting track sections.

The bearing arrangements shown in FIGS. 23–34 are illustrative, but are not intended to be limiting. Different positionings of the bearing assemblies relative to the track legs proximate to which they are located, as well as different numbers of bearing assemblies, as well as different sizes of bearing assemblies, may naturally be employed within the scope of the invention. FIGS. 35–42 illustrate alternate bearing configurations. Other additional bearing configurations which may be apparent to one of skill in the art may be provided within the scope of the present invention.

While this invention has been shown and described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A system for movably suspending an operable wall panel comprising:

a track mountable to a ceiling, said track having a pair of horizontally displaced wheel supporting surfaces and a downwardly projecting portion; and a trolley attachable to the operable wall panel, said trolley including a base plate attachable to the wall panel and a pair of wheels rotatably mounted on said base plate, each said wheel having a first surface supported on a respective one of said wheel supporting surfaces and a second surface angularly oriented to said first surface, wherein said wheels are disposed in a centered position between said wheel supporting surfaces, and wherein said downwardly projecting portion of said track is situated and arranged between said wheels for engagement with said second surfaces of said wheels when said wheels are lifted from said wheel supporting surfaces, whereby substantial movement of said wheels from said centered position is prevented.

2. The system of claim 1 wherein said downwardly projecting portion of said track is triangular in shape.

3. The system of claim 1 wherein said wheels include a shaping of an outer radial periphery complementary to a shaping of said wheel supporting surfaces of said track.

4. The system of claim 3 wherein said shaping of said outer radial periphery includes a circumferential, triangular projection.

5. The system of claim 1 wherein said downwardly projecting portion of said track is integral with said wheel supporting surfaces.

6. The system of claim 1 wherein said wheels have an axis of rotation extending in a venial direction.

7. A system for movably suspending an operable wall panel comprising:

a track mountable to a ceiling, said track having a pair of horizontally and vertically displaced wheel supporting surfaces defining a channel therebetween, and a soffit portion below said wheel supporting surfaces;

a trolley bolt having a proximal end disposed between said wheel supporting surfaces and a distal end extending through said channel for attachment to a wall panel;

a first wheel rotatably mounted on said proximal end of said trolley bolt said first wheel having a surface supported on one of said wheel supporting surfaces;

a second wheel rotatably mounted on said proximal end of said trolley bolt, said second wheel having a surface supported on the other of said wheel supporting surfaces; and a disc rotatably mounted on said trolley bolt adjacent said soffit portion of said track, said disc diametrically sized to prevent dislodgment of said wheels from said track when traversing a track intersection.

8. The system of claim 7 wherein said soffit portion includes a plurality of bearing blocks engaging an underside of said disc.

9. The system of claim 7 wherein said wheels include a shaping of an outer radial periphery complementary to a shaping of said wheel supporting surfaces of said track.

10. The system of claim 9 wherein said shaping of said outer radial periphery includes a circumferential, triangular projection.

11. The system of claim 7 wherein said track includes a portion configured for engagement with an upper surface of one of said wheels to centrally position said trolley bolt within said channel.

12. The system of claim 7 wherein said soffit portion of said track is integral with said wheel supporting surfaces.

13. A system for movably suspending an operable wall panel comprising.

a track, said track including a hanger bar mountable to a ceiling, a pair of soffit brackets in spaced relation and downwardly depending from said hanger bar, and a pair of contoured beams attached to said hanger bar, each said beam having a centrally depending first arm and a second arm disposed adjacent a respective one of said soffit brackets; and a trolley attachable to the operable wall panel, said trolley Including a base plate attachable to the wall panel and a pair of horizontally displaced wheel assemblies rotatably mounted on said base plate, each said wheel assembly having a first surface at a periphery thereof configured to engage a supporting surface at an end of a respective one of said first arms for support thereon and a second surface engaging an additional first arm end surface, non planar with said supporting surface, to prevent vertical movement of said trolley.

14. The system of claim 13 wherein each said wheel assembly has a third surface on said periphery and said second arm of each said beam has an end in proximity with said third surface of a respective one of said wheel assemblies, and configured to engage said third surface upon lateral movement of said trolley thereby preventing substantial lateral movement of said trolleys.

15. The system of claim 13 wherein said ends of said first and second arms of said beams are squared off ends.

16. The system of claim 15 wherein each of said wheel assemblies is a wheel, and said periphery includes a triangular groove and said third surface includes a bevel.

17. The system of claim 15 wherein each of said wheel assemblies includes a pair of juxtaposed wheels, each said wheel having a triangular projection at a periphery thereof, said peripheries cooperating to form a triangular groove.

18. The system of claim 13 wherein said soffits are integral with said hanger bar.

19. A system for movably suspending an operable wall panel comprising:

a track, said track including a hanger bar mountable to a ceiling, a pair of soffit brackets in spaced relation defining a channel and downwardly depending from said hanger bar, and a contoured beam attached to said hanger bar, said beam having a first arm disposed adjacent one of said soffits and a second arm adjacent the other of said soffits; and a trolley blot having a proximal end disposed between said first and second arms and a distal end extending through said channel for attachment to a wall panel;

a first wheel assembly rotatably mounted on said proximal end of said trolley bolt, said first wheel assembly having a surface supported on an end of one of said arms;

a second wheel assembly rotatably mounted on said proximal end of said trolley bolt, said second wheel assembly having a surface supported on an end of the other of said arms, and at least one of said wheel assemblies including a compound supporting surface, said at least one wheel assembly being supported against vertical movement by two nonplanar surfaces at said end of a respective one of said arms.

20. The system of claim 19 wherein each of said soffits terminates in a substantially horizontal portion extending below said wheel assemblies.

21. The system of claim 20 further including a disc rotatably mounted on said trolley bolt adjacent said soffit portion of said track, said disc diametrically sized to prevent dislodgment of said wheels from said track when traversing a track intersection.

22. The system of claim 21 wherein said soffit portions include a plurality of bearing blocks engaging an underside of said disc.

23. The system of claim 19 wherein said ends of said first and second arms are squared off ends.

24. The system of claim 23 wherein each of said wheel assemblies is a wheel having a periphery that includes a triangular groove and a bevel at an outer edge.

25. The system of claim 23 wherein each of said wheel assemblies includes a pair of juxtaposed wheels, each said wheel having a triangular projection at a periphery thereof, said peripheries cooperating to form a triangular groove.

26. The system of claim 19 wherein said soffits are integral with said hanger.

* * * * *

UNITED STATES PATENT AND TRADEMARK OFFICE

CERTIFICATE OF CORRECTION

PATENT NO. : 6,374,456 B1
DATED : April 23, 2002
INVENTOR(S) : Fort et al.

It is certified that error appears in the above-identified patent and that said Letters Patent is hereby corrected as shown below:

Column 4,
Line 20, delete “at” and substitute “art”

Column 13,
Line 2, delete “venial” and substitute “vertical”

Signed and Sealed this

Twenty-fifth Day of June, 2002

*Attest:*

*Attesting Officer*

JAMES E. ROGAN
*Director of the United States Patent and Trademark Office*